US012516663B2

(12) United States Patent
Morris et al.

(10) Patent No.: US 12,516,663 B2
(45) Date of Patent: Jan. 6, 2026

(54) AIR OPERATED DOUBLE DIAPHRAGM PUMP WITH ACCESSIBLE FEATURES

(71) Applicant: Warren Rupp, Inc., Mansfield, OH (US)

(72) Inventors: Brent Morris, Lexington, OH (US); Mark Frye, Mansfield, OH (US); Jim Rockwell, Bellville, OH (US)

(73) Assignee: Warren Rupp, Inc., Mansfield, OH (US)

( * ) Notice: Subject to any disclaimer, the term of this patent is extended or adjusted under 35 U.S.C. 154(b) by 143 days.

(21) Appl. No.: 18/301,649

(22) Filed: Apr. 17, 2023

(65) Prior Publication Data

US 2023/0332590 A1 Oct. 19, 2023

Related U.S. Application Data

(60) Provisional application No. 63/331,980, filed on Apr. 18, 2022.

(51) Int. Cl.
*F04B 43/073* (2006.01)
*F04B 53/00* (2006.01)

(52) U.S. Cl.
CPC ..... *F04B 43/0736* (2013.01); *F04B 53/001* (2013.01)

(58) Field of Classification Search
CPC ..... F04B 43/02; F04B 43/06; F04B 43/073; F04B 43/0736; F04B 53/001; F04B 53/002; F04B 43/026; F04B 53/22
See application file for complete search history.

(56) References Cited

U.S. PATENT DOCUMENTS 3,838,946 A * 10/1974 Schall ..... F01L 15/08 417/393
4,381,180 A * 4/1983 Sell ..... F04B 43/0736 417/393

(Continued)

FOREIGN PATENT DOCUMENTS

EP 0304210 A2 2/1989
EP 2728189 A1 5/2014

(Continued)

OTHER PUBLICATIONS

The International Search Report and the Written Opinion of the International Search Authority, or the Declaration of the corresponding PCT Application No. PCT/US2023/018832, Date of Mailing Sep. 18, 2023, 19 pages.

(Continued)

*Primary Examiner* — Michael J Tsai
*Assistant Examiner* — Charles W Nichols
(74) *Attorney, Agent, or Firm* — Tucker Ellis LLP

(57) ABSTRACT

One or more techniques and/or systems are disclosed for an air operated double diaphragm pump with a selectably removable valve body for convenient repair and maintenance. The pump may include an inlet, an outlet, and first and second diaphragm chamber housings. Each first and second diaphragm chamber housings defines a diaphragm chamber. A valve body housing is arranged between the first and second diaphragm chamber housings. A valve body is arranged within the valve body housing, is in fluid communication with the diaphragm chambers of the first and second diaphragm chamber housings, and includes pilot signal ports, diaphragm chamber inlet ports, and chamber exhaust ports that are all accessible on a signal surface of the valve body. The signal surface may be on a same side of the valve body. To stabilize the pump during repair and maintenance, (Continued)

stabilizing feet may project from outer edges of the diaphragm chamber housings.

19 Claims, 22 Drawing Sheets

(56) References Cited

U.S. PATENT DOCUMENTS

| | | | | |
|---|---|---|---|---|
| 6,241,487 | B1 * | 6/2001 | Reynolds | F04B 43/0736 417/393 |
| 6,830,441 | B1 | 12/2004 | Williams | |
| 8,382,445 | B2 * | 2/2013 | Roseberry | F04B 9/135 91/335 |
| 2004/0047748 | A1 * | 3/2004 | Roberts | F04B 43/0736 417/395 |
| 2009/0196779 | A1 | 8/2009 | Weaver et al. | |
| 2013/0078125 | A1 * | 3/2013 | Headley | F04B 43/026 417/521 |
| 2015/0004003 | A1 | 1/2015 | Roberts et al. | |
| 2015/0226192 | A1 | 8/2015 | Hines et al. | |
| 2021/0207593 | A1 * | 7/2021 | Yamada | F04B 43/026 |

FOREIGN PATENT DOCUMENTS

| | | | |
|---|---|---|---|
| EP | 3805561 | A1 | 4/2021 |
| EP | 3809026 | A1 | 4/2021 |
| FR | 2644852 | A1 | 9/1990 |
| WO | 2020247442 | A1 | 12/2020 |

OTHER PUBLICATIONS

The International Search Report and the Written Opinion of the International Search Authority, or the Declaration of the corresponding PCT Application No. PCT/US2023/062977, Date of Mailing Feb. 22, 2023, 18 pages.

* cited by examiner

AIR OPERATED DOUBLE DIAPHRAGM PUMP WITH ACCESSIBLE FEATURES

RELATED APPLICATIONS

This application claims priority to U.S. Provisional Application Ser. No. 63/331,980 filed on Apr. 18, 2022, which is incorporated herein by reference in its entirety.

BACKGROUND

Fluid-operated pumps, such as diaphragm pumps, are widely used particularly for pumping liquids, solutions, viscous materials, slurries, suspensions or flowable solids. Double diaphragm pumps are well known for their utility in pumping viscous or solids-laden liquids, as well as for pumping plain water or other liquids, and high or low viscosity solutions based on such liquids. Accordingly, such double diaphragm pumps have found extensive use in pumping out sumps, shafts, and pits, and generally in handling a great variety of slurries, sludges, and waste-laden liquids. Fluid driven diaphragm pumps offer certain further advantages in convenience, effectiveness, portability, and safety. Double diaphragm pumps are rugged and compact and, to gain maximum flexibility, are often served by a single intake line and deliver liquid through a short manifold to a single discharge line.

Although known diaphragm pumps work well for their intended purpose, several disadvantages exist. Conventional double diaphragm pumps have a main air valve body containing a main air valve assembly and a pilot air valve body containing a pilot valve assembly. The valve bodies are mechanically coupled together and require the use of a seal to prevent leaks. Servicing these valve assemblies typically requires removing the pump from its installed location or removing the pump chambers. Further, servicing often requires a full tear down of the pump. When tearing down the pump, the pilot actuator pins, which interact with the diaphragms and the pilot valve spool, may be positioned inside of the valve sleeve and prevent removal of the pilot valve assembly. Additionally, while the pump is being serviced, the pump chamber is susceptible to falling over or rolling away due to its circular shape.

Additionally, it is costly and burdensome to retrieve pump performance information from conventional double diaphragm pumps for use in controlling the pumping process and diagnosing performance issues. Conventional systems require modification to the chamber and integration of pins and sensors to measure inner chamber pressure for stroke counting or leak detection. Further, conventional double diaphragm pumps are often made of conductive materials for operation purposes but this also adds to the cost of the overall pump.

Accordingly, there is a need in the art for a double diaphragm pump that is more readily serviceable by having a single valve body that is selectably removable from the double diaphragm pump for servicing. Additionally, there is a need in the art for a double diaphragm pump where information about the performance of the pump is more accessible without costly modification to the pump. Further, there is a need in the art to reduce the amount of conductive material used to construct the pump to reduce costs.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation, an air operated double diaphragm pump may include an inlet and an outlet. Further, the pump may include a first diaphragm housing and a second diaphragm housing, each of which define a diaphragm chamber. A valve body housing is arranged between the first and second diaphragm chamber housings. A valve body is arranged within the valve body housing. The valve body is in fluid communication with the diaphragm chambers of the first and second diaphragm chamber housings and comprises pilot signal ports, diaphragm chamber inlet ports, and chamber exhaust ports that are all accessible on a signal surface of the valve body.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1A:
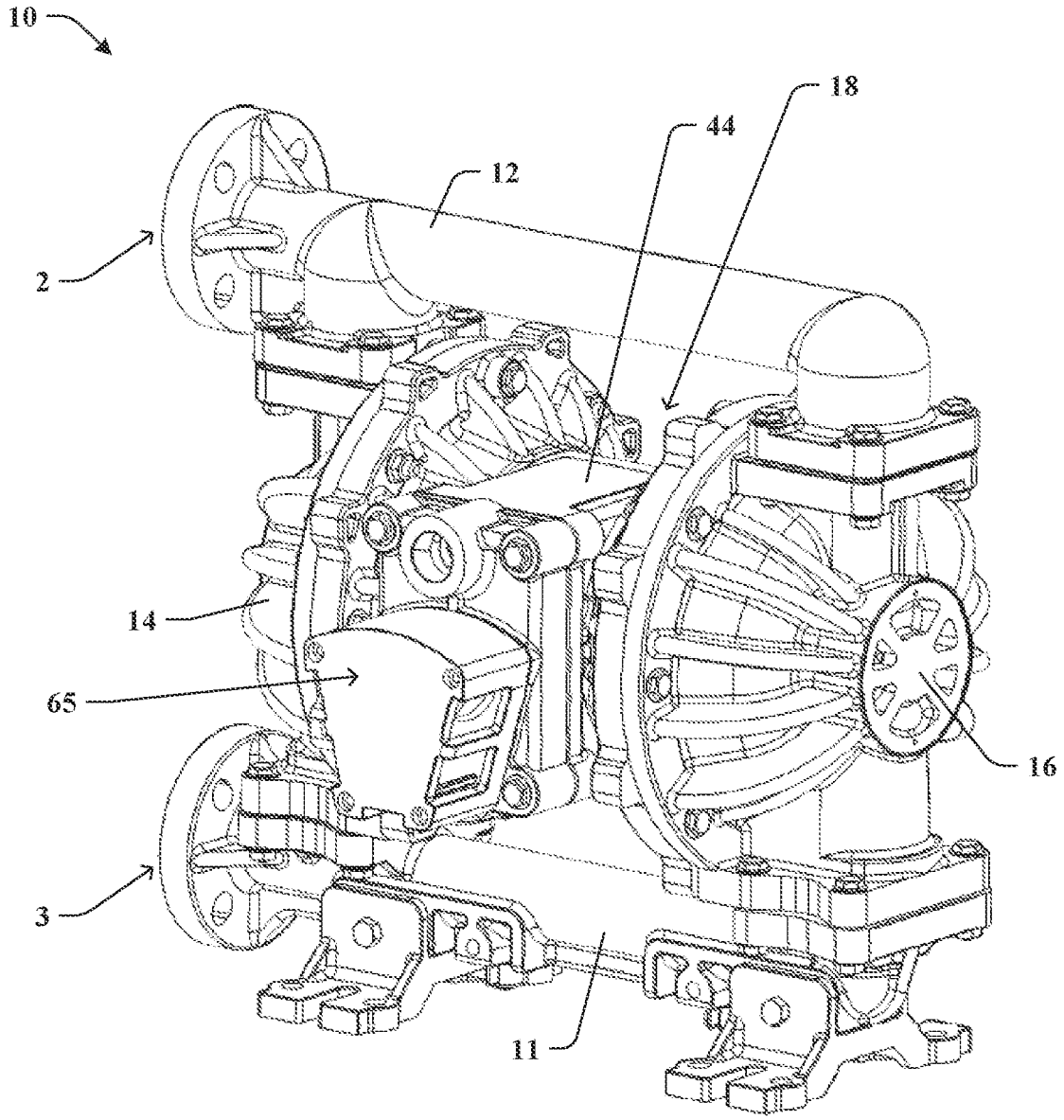
FIGS. 1A, 1B, and 1C illustrate various views of some implementations of an air operated double diaphragm pump with accessible features as described herein.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Figure 1B:
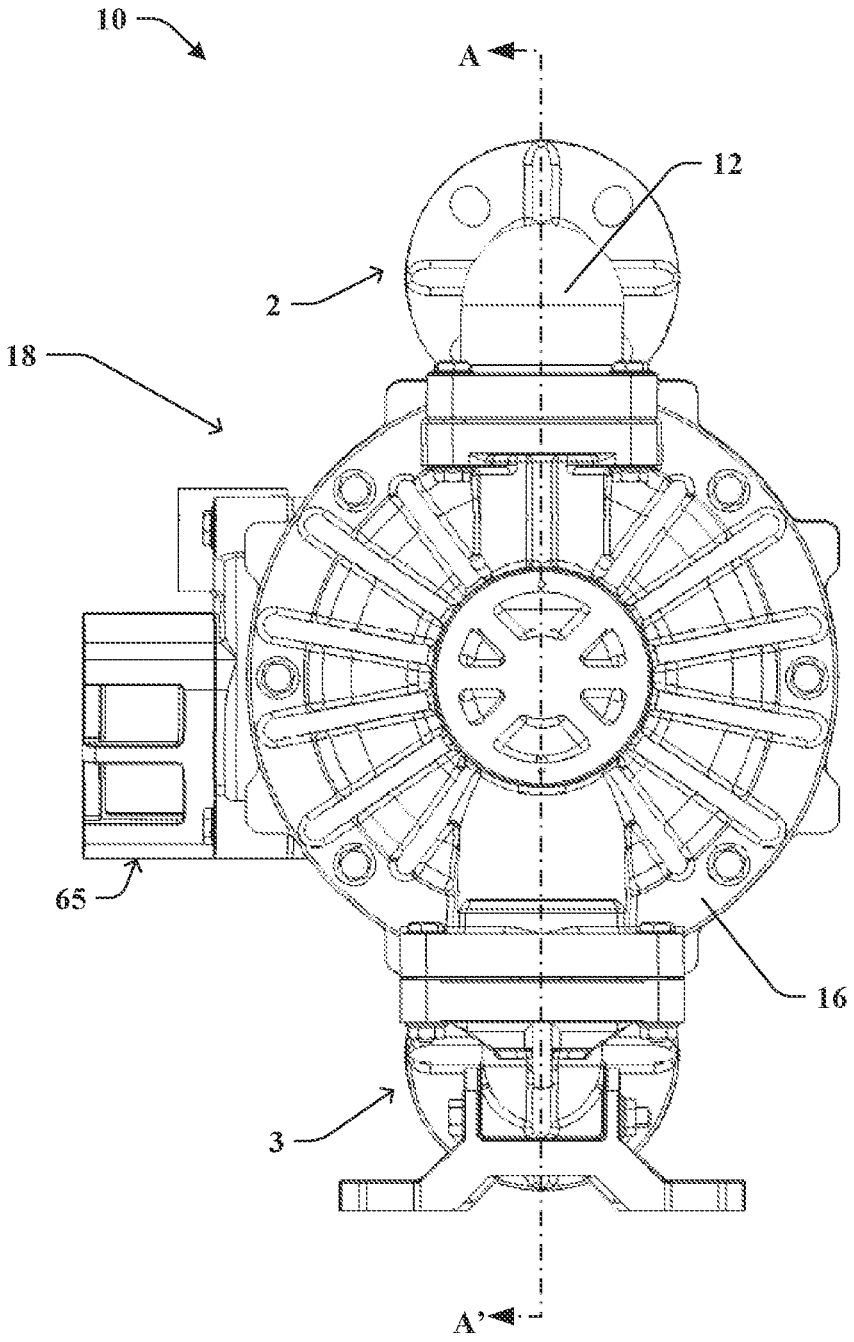
Figure 1C:
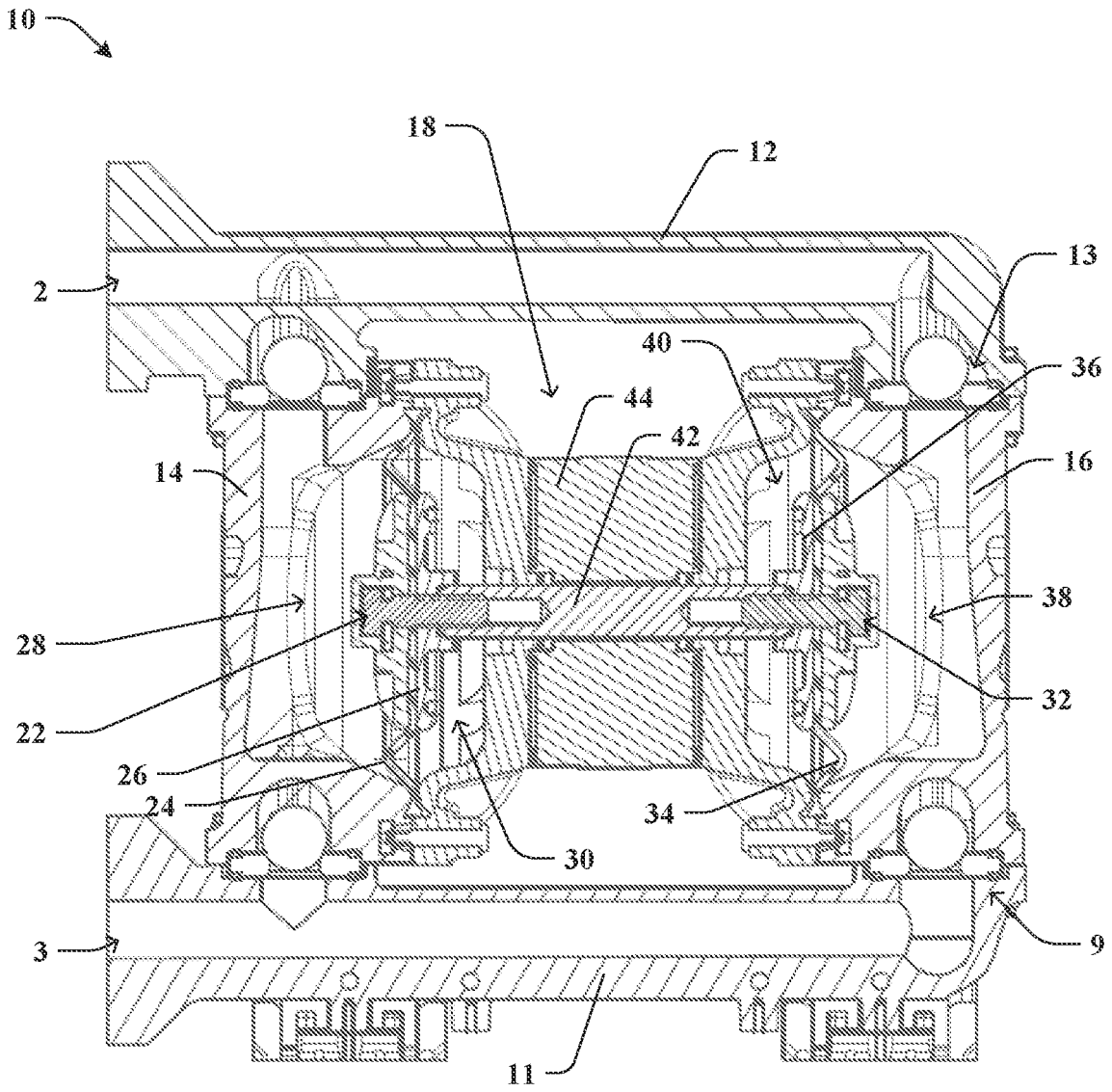

With reference now to FIGS. 1A, 1B, and 1C, an air operated double diaphragm pump 10 will generally be described. FIG. 1B illustrates a side-view of the perspective view of FIG. 1A. The cross-sectional view of FIG. 1C may correspond to cross-section line AA' of FIG. 1B. The pump 10 may comprise an inlet housing 11, an outlet housing 12, a first diaphragm chamber housing 14, a second diaphragm chamber housing 16, and a center section 18 disposed between the first and second diaphragm chamber housings 14, 16. The first diaphragm chamber housing 14 may include a first diaphragm assembly 22 comprising a first diaphragm 24 and a first diaphragm plate 26. The first diaphragm 24 may be coupled to the first diaphragm plate 26 and may extend across the first diaphragm chamber housing 14 thereby forming a movable wall defining a first pumping chamber 28 and a first diaphragm chamber 30. The second diaphragm chamber housing 16 may be substantially the same as the first diaphragm chamber housing 14 and may include a second diaphragm assembly 32 comprising a second diaphragm 34 and a second diaphragm plate 36. The second diaphragm 34 may be coupled to the second diaphragm plate 36 and may extend across the second diaphragm chamber housing 16 to define a second pumping chamber 38 and a second diaphragm chamber 40. A connecting rod 42 may be operatively connected to and extend between the first and second diaphragm plates 26, 36.

Each of the first and second pumping chambers 28, 38 comprises an inlet check valve 9 at an inlet end of the respective first or second pumping chambers 28, 38 and comprises an outlet check valve 13 at an outlet end of the respective first or second pumping chambers 28, 38. The inlet and outlet check valves 9, 13 selectively open and close to allow the fluid to travel into and out of the first and/or second pumping chamber 28, 38. In some implementations, the inlet and/or outlet check valves 9, 13 may be ball check valves as shown in FIG. 1C. In some other implementations, the inlet and/or outlet check valves 9, 13 may be some other type of valve such as a flap valve, a spring valve, or some other suitable check valve. When one of the inlet check valves 9 is in the closed position, the other inlet check valve 9 is in the open position. Similarly, when one of the inlet check valves 9 is in the closed position, the outlet check valve 13 directly above the closed inlet check valve 9 is in the open position to allow the respective pumping chamber 28 or 38 to fill with fluid.

During operation of the pump 10, a main entry inlet 3 may receive fluid that is pumped through the inlet housing 11 and into the first or second pumping chambers 28, 38. When the inlet check valve 9 of the first pumping chamber 28 is opened, the inlet check valve 9 of the second pumping chamber 38 is closed, the outlet check valve 13 of the first pumping chamber 28 is closed, and the outlet check valve 13 of the second pumping chamber is opened. Additionally, when the inlet check valve 9 of the first pumping chamber 28 is opened, fluid flows into the first pumping chamber 28 and forces the first diaphragm plate 26 to compress the first diaphragm chamber 30. The first diaphragm plate 26 moves towards the center section 18 and forces air into the second diaphragm chamber 40. As air fills the second diaphragm chamber 40, the second diaphragm plate 36 moves towards the second pumping chamber 38 thereby forcing fluid to exit the second pumping chamber 38 via the outlet check valve 13 of the second pumping chamber 38 and a main exit outlet 2. The first and second diaphragm plates 26, 36 move in the tandem because they are connected via the connecting rod 42. Once the first pumping chamber 28 is filled with fluid, the inlet and outlet check valves 9, 13 change positions such that fluid begins to flow into the second pumping chamber 38 as fluid exits from the first pumping chamber 28. This process can be continuously repeated to provide continuous fluid flow between the main entry inlet 3 and the main exit outlet 2.

Because of this continuous pumping process, various parts of the pump 10 may need to be cleaned, replaced, or undergo other maintenance throughout the lifetime of the pump 10. As will be discussed further herein, several features of the pump 10 are configured to reduce pump damage, reduce pump down-time for maintenance, and increase access to various parts of the pump for maintenance, thereby increasing performance and longevity of the overall pump.

Figure 2:
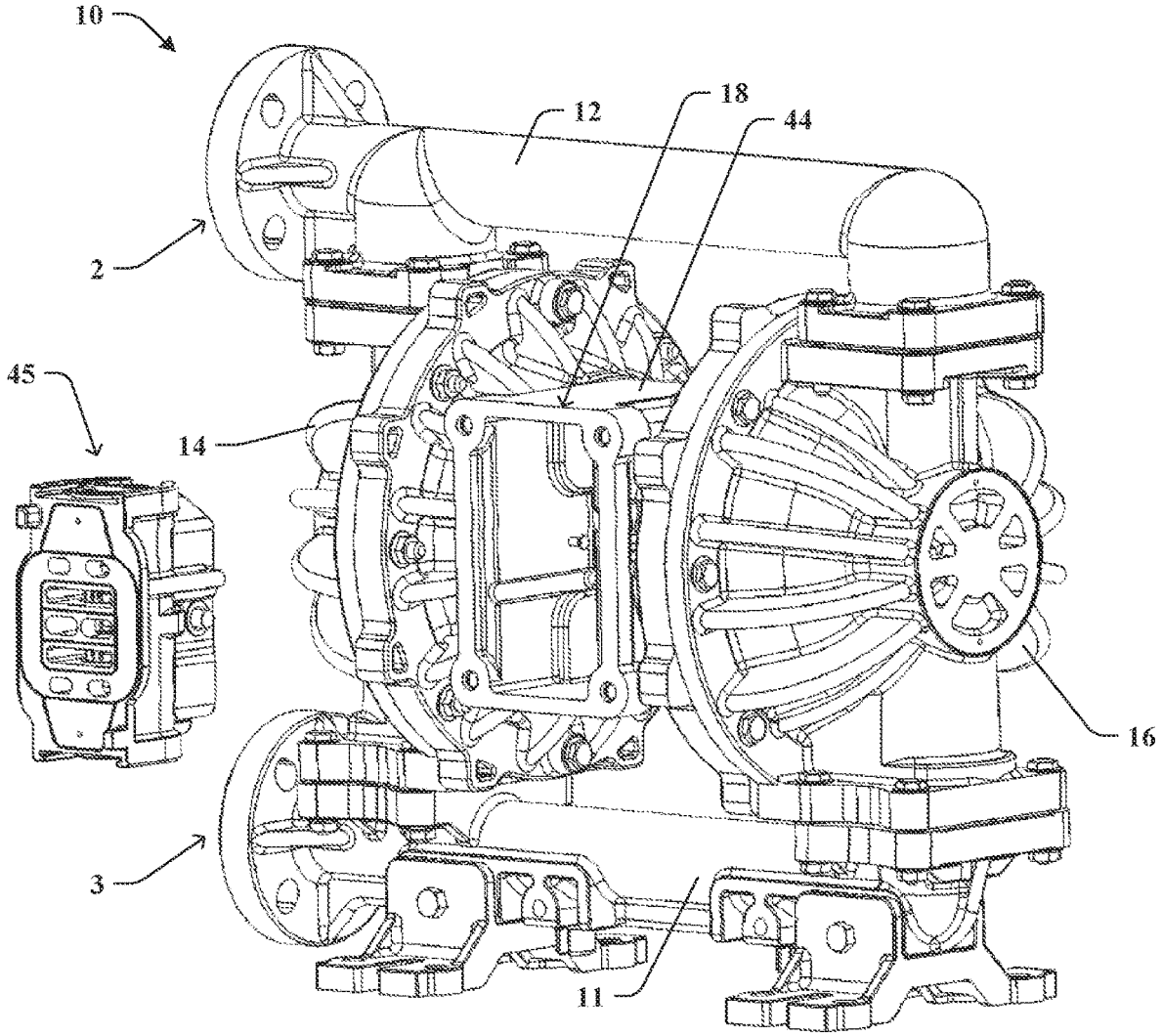
FIG. 2 illustrates a perspective view of some implementations of a selectably removable valve body outside of the air operated double diaphragm pump as described herein.

With reference now to FIG. 2, a partially exploded view is illustrated to show that in some implementations, the center section 18 of the pump 10 may include a valve body 45 disposed within a valve body housing 44. The valve body housing 44 is arranged between the first and second diaphragm chamber housings 14, 16.

Figure 3A:
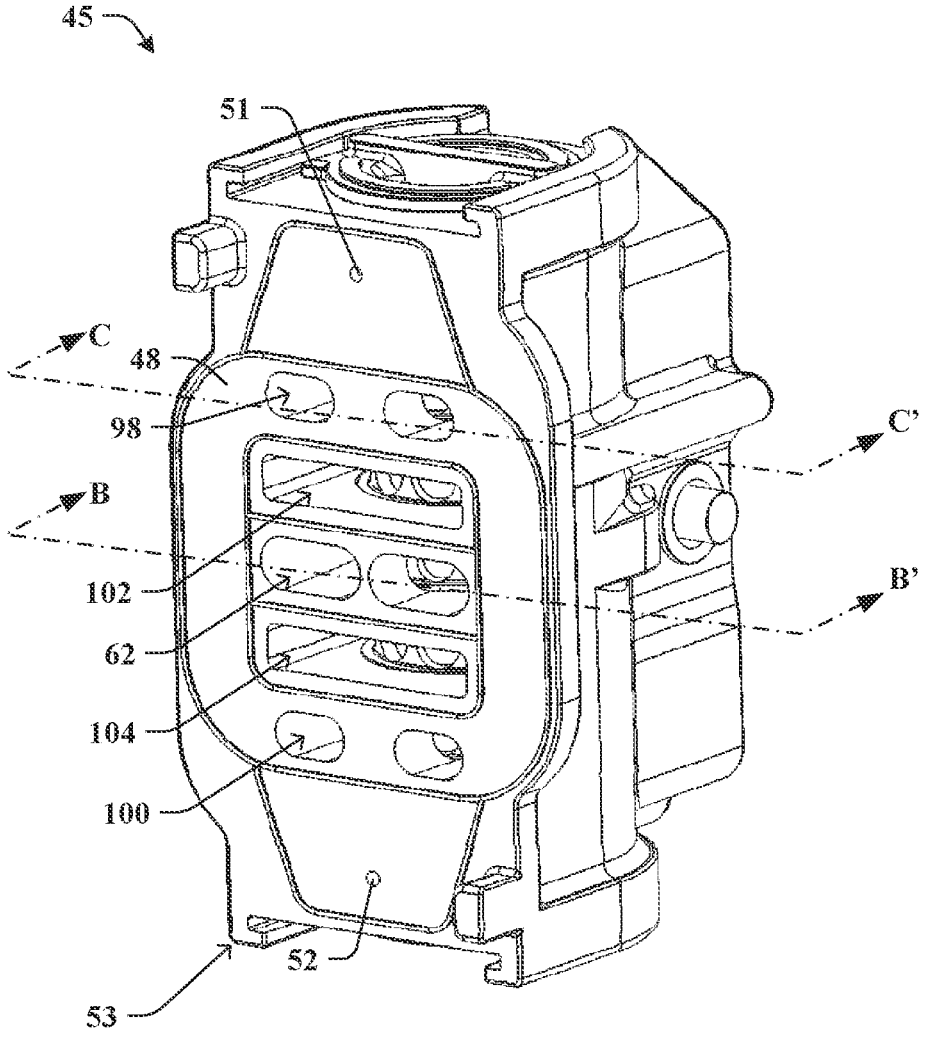
FIG. 3A illustrates a perspective view of a front side of some implementations of the selectably removable valve body as described herein.
Figure 3B:
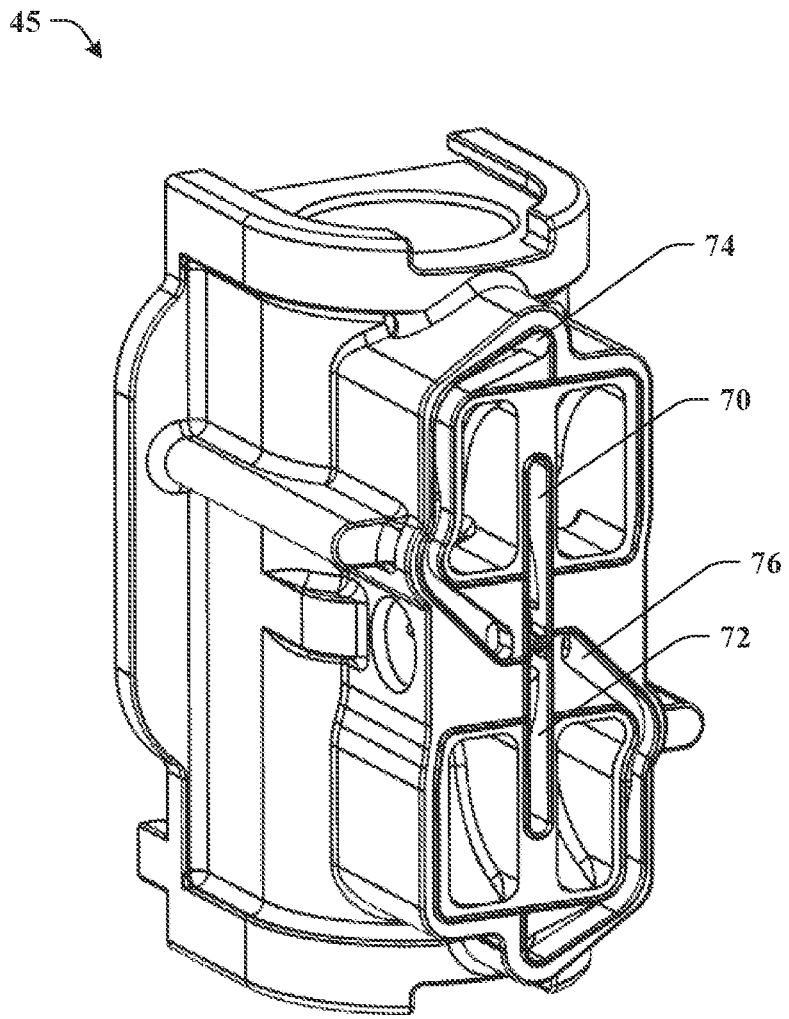
FIG. 3B illustrates a perspective view of a back side of some implementations of the selectably removable valve body as described herein.
Figure 4:
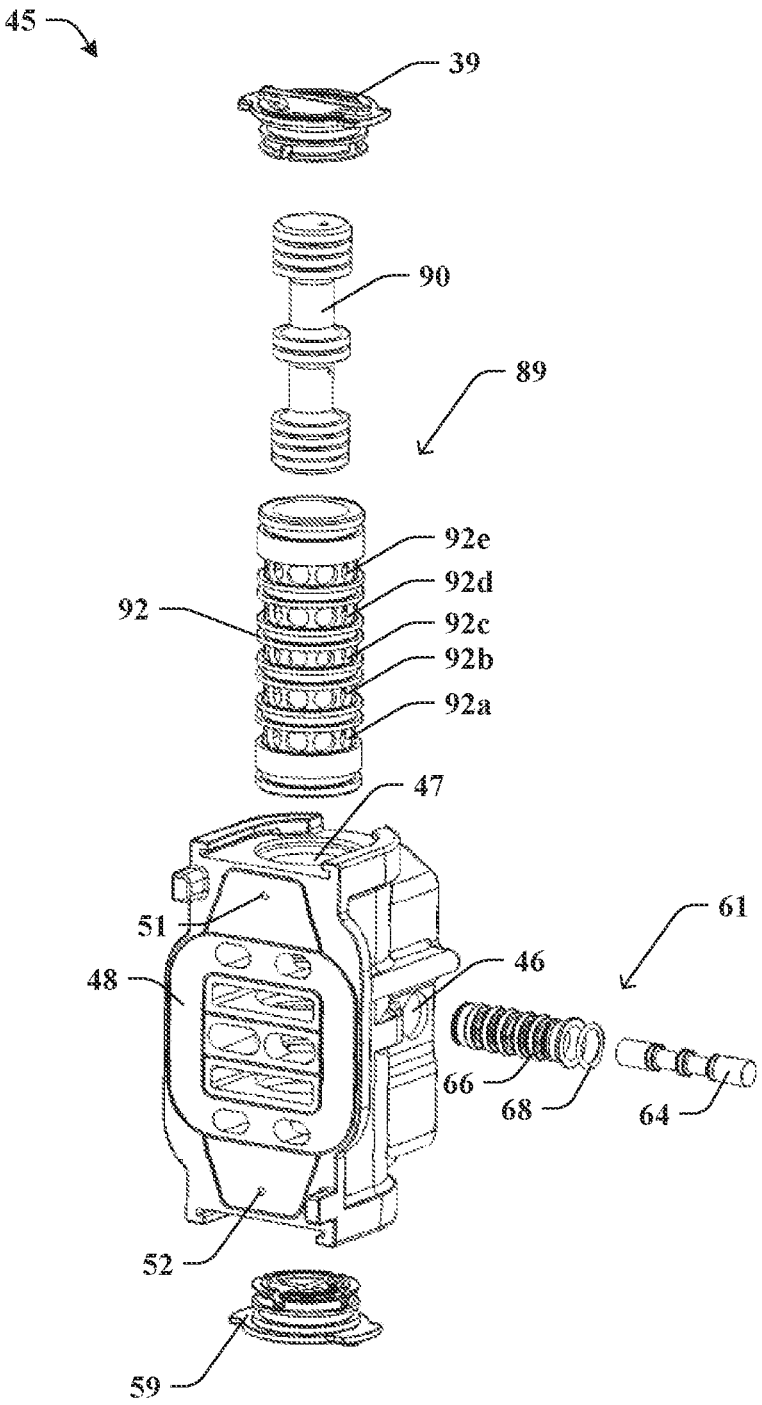
FIG. 4 illustrates an exploded view of some implementations of the selectably removable valve body as described herein.

With additional reference to FIGS. 3A, 3B, and 4, the valve body 45 may comprise first and second pilot inlet ports 70, 72, first and second main channels 74, 76, a pilot valve bore 46, a main fluid valve bore 47, a pilot valve assembly 61, and a main fluid valve assembly 89. In some implementations, the valve body 45 may comprise a first pilot signal port 51, a second pilot signal port 52, a first compressed air feed 98, a second compressed air feed 100, a first chamber port 102, a second chamber port 104, and a muffler exhaust port 62. The first and second compressed air feeds 98, 100 supply the main fluid valve assembly 89 with compressed air. The first and second chamber ports 102, 104 are utilized for both chamber exhaust and chamber pressurization. The first pilot signal port 51 and the second pilot signal port 52 are connected to the first main channel 74 and the second main channel 76, respectively. In some other implementations (e.g., as illustrated in FIG. 5B), the first pilot signal port 51 and the second pilot signal port 52 may be omitted from the valve body 45.

The valve body 45 may comprise a valve body signal surface 48. The valve body signal surface 48 may be substantially planar and may comprise the first pilot signal port 51, the second pilot signal port 52, the first compressed air feed 98, the second compressed air feed 100, the first chamber port 102, the second chamber port 104 and the muffler exhaust port 62. The first compressed air feed 98 is fluidly connected to the first chamber port 102 to provide and receive compressed air to the first diaphragm chamber housing 14, and the second compressed air feed 100 is fluidly connected to the second chamber port 104 to provide and receive compressed air to the second diaphragm chamber housing 16. The location of all these ports on one planar surface that is on a same side of the valve body 45 may simplify pump monitoring and diagnostics. For example, only a removable plate (e.g., 91 of FIG. 5B) and front gasket (e.g., 93 of FIG. 5B) would need to be removed from the valve body housing 44 to access each one of the ports on the valve body signal surface 48 for monitoring, diagnostics, and/or maintenance of the ports on the valve body signal surface 48.

The pilot valve assembly 61 may be disposed within the pilot valve bore 46. The first and second pilot inlet ports 70, 72 are connected with one another and function as the compressed air supply to the pilot valve assembly 61. The first and second pilot inlet ports 70, 72 are on a backside of the valve body 45, as shown in FIG. 3B. By being on the backside of the valve body 45, the first and second pilot inlet ports 70, 72 are not interfered with if the valve body 45 is only accessed from the frontside for maintenance. For example, the valve body housing 44 may be opened to access a front side of the valve body 45 without actually removing the valve body 45 from the valve body housing 44. Then, the backside of the valve body 45, which includes the first and second pilot inlet ports 70, 72 remain covered by the valve body housing 44 while the frontside of the valve body 45 is accessed. Less interference with the first and second pilot inlet ports 70, 72 during maintenance reduces damage and thus, improves performance of the overall pump 10.

Figure 5A:
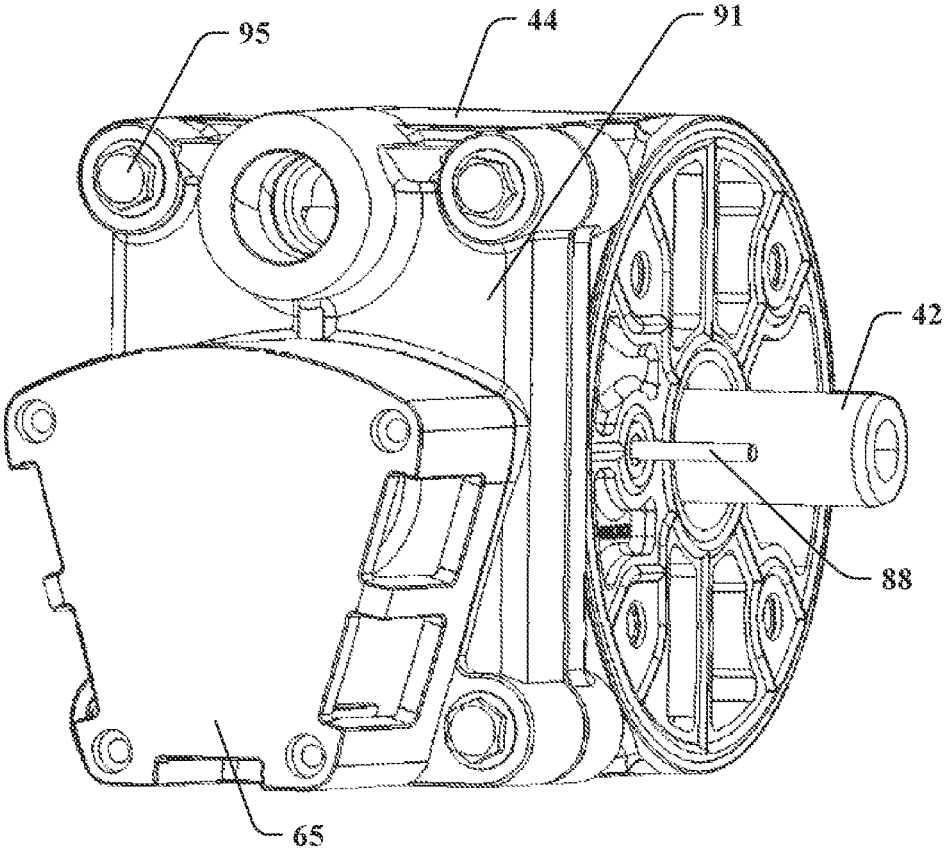
FIGS. 5A, 5B, and 5C illustrate various views of some implementations of the selectably removable valve body within a valve body housing as described herein.
Figure 5B:
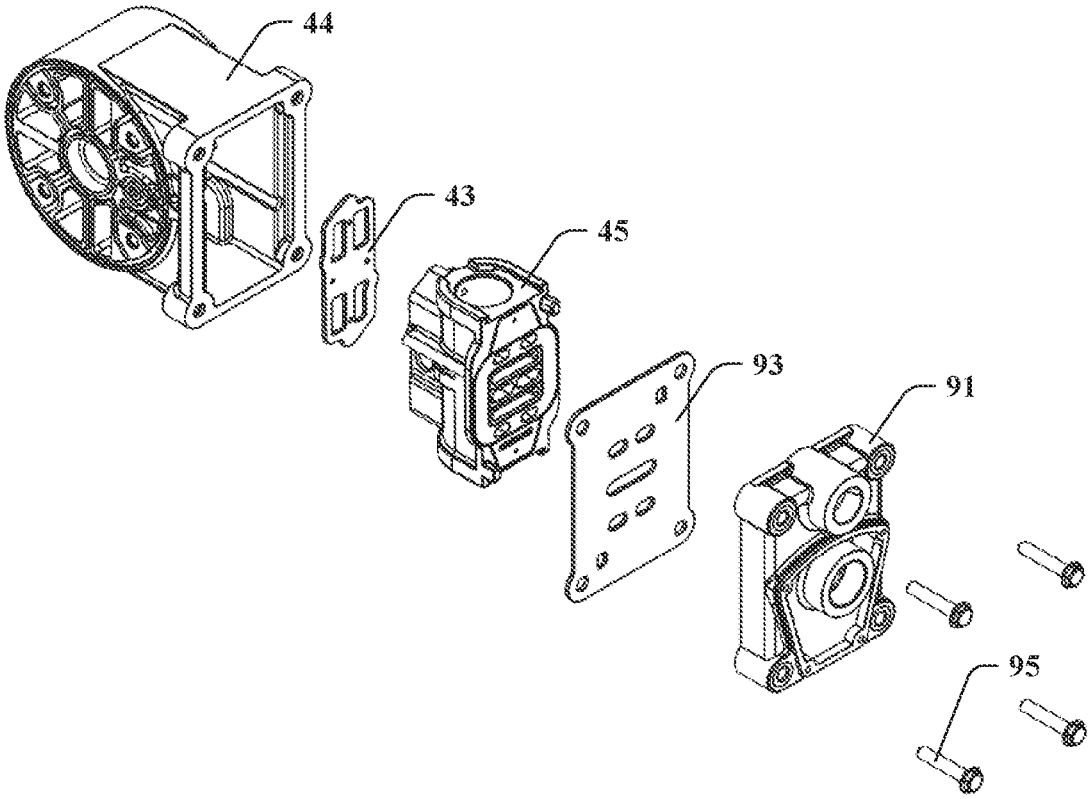
Figure 5C:
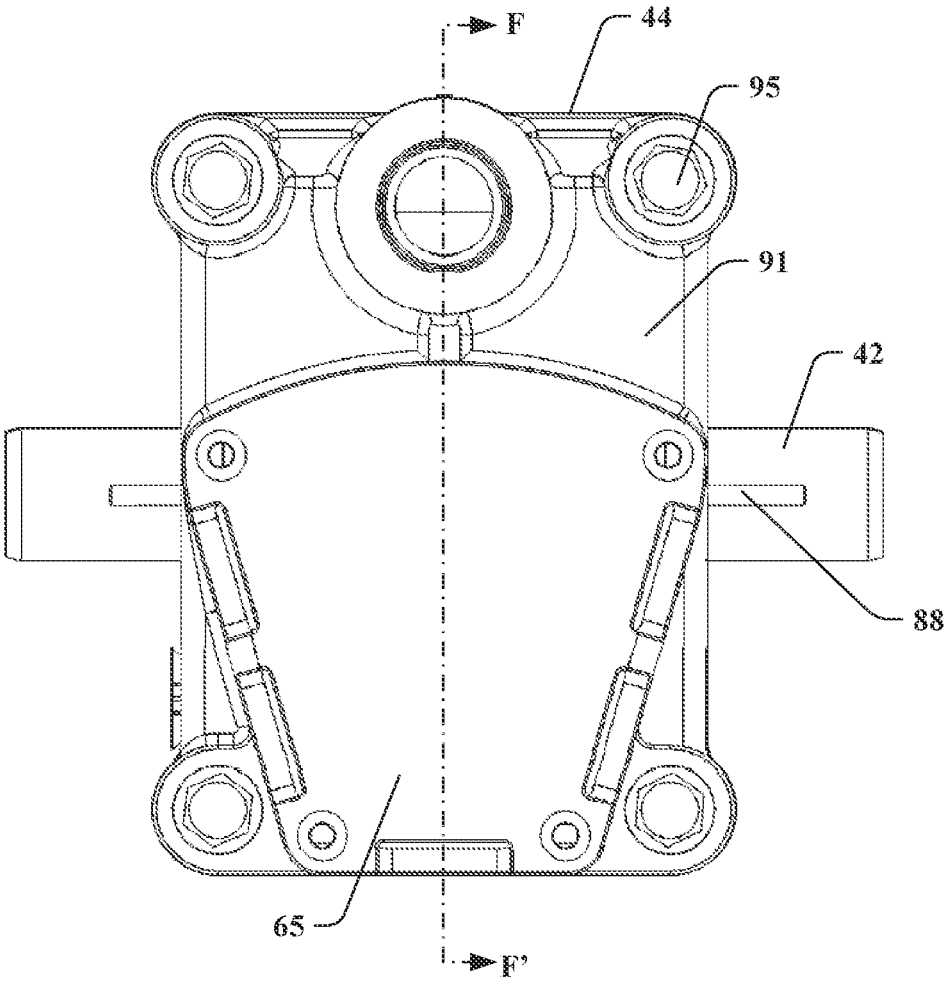

With additional reference to FIGS. 5A, 5B, and 5C, the valve body 45 may be enclosed within the valve body housing 44 and a removable plate 91. The removable plate 91 may be operably connected to the valve body housing 44 by fasteners 95. The fasteners 95 may be or comprise screws, brackets, bolts, wing-nuts, or the like. Thus, to remove the valve body 45, the fasteners 95 are removed from the valve body housing 44 and the removable plate 91. Then, the removable plate 91 may be removed from the valve body housing 44. Additionally, in some implementations, a front gasket 93 is arranged between the valve body 45 and the removable plate 91. Further, a back gasket 43 is arranged between the valve body 45 and the valve body housing 44. As such, after the removable plate 91 is removed from the valve body housing 44, the front gasket 93 is also removed from the valve body housing 44 and the valve body 45. Then, the valve body 45 may be removed from an opened side of the valve body housing 44. Thus, in some implementations, only one side of the valve body housing 44 and thus, only one side of the overall pump needs to be accessed to remove the valve body 45. Additionally, the valve body 45 may be accessed from the valve body housing 44 by simply removing some fasteners 95, a removable plate 91, and a front gasket 93.

In some implementations, the removable plate 91 may also be or comprise a sensor housing, which would also allow easy access to each of the ports on the valve body signal surface 48 and also easy access to the sensors on the removable plate 91. For example, a device may be used to monitor the pressure levels and changes through the ports on the valve body signal surface 48 without requiring costly physical modification to the pump 10 thereby enhancing the usability, efficiency, and durability of the pump 10. Further, this simplified access reduces the risk of damaging parts of the pump 10 other than features of the valve body signal surface 48 is reduced, which also extends the lifetime of the overall pump 10.

In some implementations, as shown in FIG. 2, for example, the valve body 45 may be selectably removable from the valve body housing 44. Therefore, the rest of the pump 10 can remain stationary while the valve body 45 is removed from the valve body housing 44. In some implementations, the valve body 45 is removed automatically using machinery, is removed by hand by an operator, is removed by machinery controlled by an operator, or the like. In some implementations, the valve body 45 comprises handles, notches, or the like that are used for machinery and/or an operator to securely grab onto the valve body 45 for removal.

In some implementations, the valve body 45 may be removed for maintenance to the valve body 45 or other parts of the pump 10 accessible through the valve body housing 44. In some instances, the valve body 45 may malfunction due to, for example, wear and tear. Because the valve body 45 is removable from the valve body housing 44, a malfunctioning valve body 45 can be completely replaced, thereby extending the lifetime of the overall pump 10. Time, materials, and cost are saved because the valve body 45 can be replaced instead of the entire pump 10. Further, because fewer features of the pump 10 have to be disassembled to access the valve body 45 and components thereof, including the main fluid valve assembly 89 and the pilot valve assembly 61, the risk of damaging parts of the pump 10 other than the valve body 45 is reduced, which also extends the lifetime of the overall pump 10.

Additionally, in some implementations, when the valve body 45 is arranged within the valve body housing 44, the removable plate 91 covers the exposed side of the valve body 45 such that the valve body 45 is completely enclosed in the valve body housing 44 and the removable plate 91. In some implementations, the surface of the pump 10 comprises a conductive material. Because the valve body 45 is within the pump 10 and has no exposed surfaces to the outer environment when within the valve body housing 44 and the removable plate 91, the valve body 45 may comprise a polymer material. Polymer materials are non-conductive and also lower in material cost and manufacturing cost/time when compared to other materials (e.g., conductive polymers, metals, etc.). Therefore, the valve body 45 cost may be reduced due to its arrangement within the valve body housing 44. Further, a polymer material may be lighter in weight than metallic implementations, in some implementations, such that removal of the valve body 45 is less cumbersome. If the valve body 45 is lighter in weight, then the valve body 45 is less likely to be dropped during removal from the valve body housing 44. In other implementations, the valve body 45 may still comprise a conductive material, such as a metal, for structural integrity in a particular application or the like. In yet other implementations, the valve body 45 may comprise a combination of conductive and non-conductive materials. For example, in some such other implementations, at least air valves within the valve body 45 may comprise a polymer material which is non-conductive and lower in cost, while the rest of the valve body 45 may comprise a metal material, which is conductive.

As shown in FIG. 4, the pilot valve assembly 61 and the main fluid valve assembly 89 are arranged within the same valve body 45, which improves accessibility and convenience of servicing the valve body 45 features upon removal. Further, the number of seals connecting the pilot valve assembly 61 and the main fluid valve assembly 89 are reduced, thereby reducing potential seams for leakage. The pilot valve assembly 61 and the main fluid valve assembly 89 may be selectably removable from the valve body 45. Thus, the parts of the pilot valve assembly 61 (e.g., 64, 66, 68) and the parts of the main fluid valve assembly 89 (e.g., 90, 92) may also be selectably accessed. Therefore, maintenance can also be performed on the selectably removable pilot valve assembly 61 and/or the main fluid valve assembly 89 to extend the lifetime of the pump 10. Further, with a reduced number of seals for the pilot valve assembly 61 and the main fluid valve assembly 89, the time it takes to assemble and disassemble the valve body 45 is reduced.

For example, in some implementations, the pilot valve assembly 61 may be retained in the valve body 45 with a pilot valve retainer 68. The pilot valve retainer 68 may be a snap rings, retaining ring, a pin, a cap or other means of mechanical retention. The main fluid valve assembly 89 may be retained in the valve body 45 with valve body caps 39, 59. Alternatively, the main fluid valve assembly 89 may also be retained with a snap ring, retaining ring, a pin, or other commonly used means of mechanical retention. In some instances, the pilot valve retainer 68 may be an o-ring that breaks down over time. Due to the selectably removable valve body 45 from the pump 10 and the selectably removable pilot valve assembly 61 from the valve body 45, the pilot valve retainer 68 may be replaced without disrupting other parts of the pump 10 outside of the valve body 45. Additionally, the valve body 45 and features thereof may be quickly replaced and/or adjusted by operators due to this selectable removability. Thus, loss of production time due to pump 10 maintenance is minimized.

Further, in some implementations, the main fluid valve assembly 89 further comprises an upper valve body cap 39 and a lower valve body cap 59 configured to hold the main fluid valve sleeve 92 and main fluid valve spool 90 within the valve body 45. In some implementations, sensors are placed within the main fluid valve assembly 89 to detect the pump 10 performance. For example, in some instances, an air pressure sensor allows operators of the pump 10 to know when the main fluid valve assembly needs to be serviced. Because of the selectable removability of the main valve assembly, operators can easily access the upper and lower valve body caps 39, 59 for sensor placement on the upper and lower valve body caps 39, 59 to monitor pump performance when desired.

Figure 6:
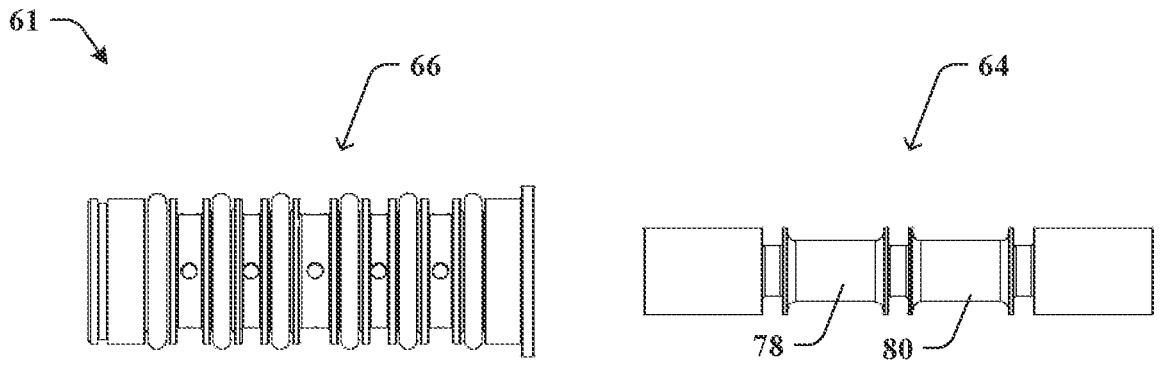
FIG. 6 illustrates an exploded view of some implementations of a pilot valve assembly as described herein.
Figure 7:
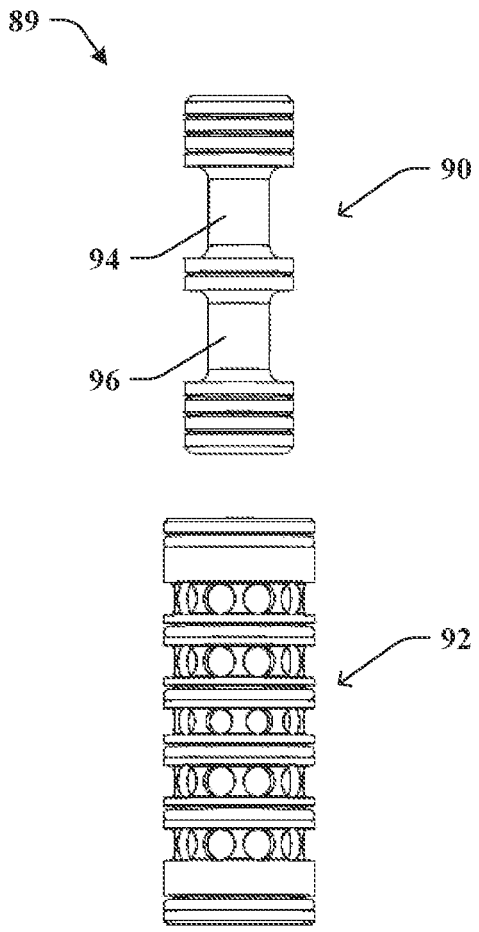
FIG. 7 illustrates an exploded view of some implementations of a main fluid valve assembly as described herein.

With additional reference to FIGS. 6 and 7, the pilot valve assembly 61 may comprise a pilot valve spool 64 disposed within a pilot valve sleeve 66. The main fluid valve assembly 89 may be disposed within the main fluid valve bore 47. The main fluid valve assembly 89 may comprise a main fluid valve spool 90 disposed within a main fluid valve sleeve 92. The main fluid valve spool 90 and the pilot valve spool 64 can both be accessed at the valve body 45; this reduces the number of parts to disassemble in order to access the main fluid valve spool 90 and the pilot valve spool 64, which in turn reduces pump damage, reduces pump down-time for maintenance, and increases performance and longevity of the overall pump. The pilot valve assembly 61 may at least partially allow for the control of the movement of the main fluid valve assembly 89 between a first and a second main valve position, thereby causing compressed air to flow into either the first or second diaphragm chambers 30, 40 as will be more fully described herein.

Figure 8:
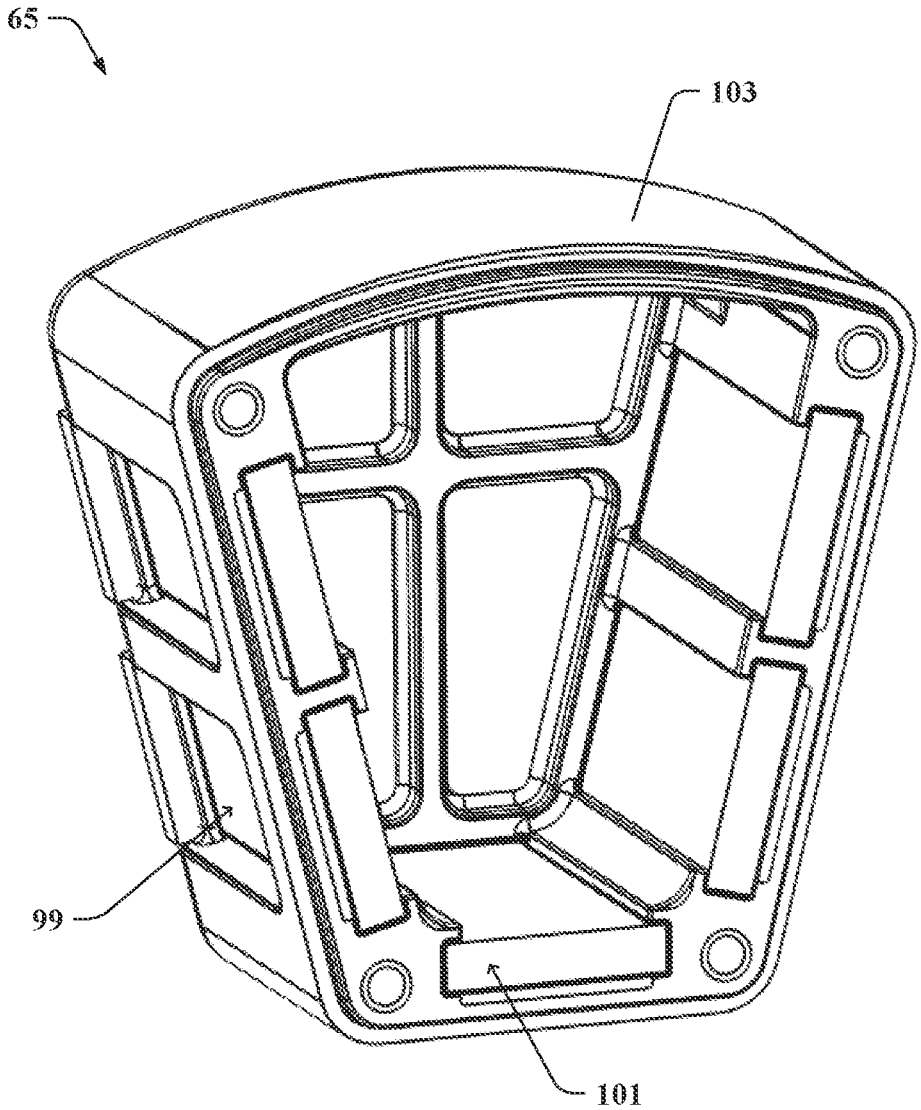
FIG. 8 illustrates a perspective view of some implementations of a muffler for an air operated double diaphragm pump as described herein.

With additional reference to FIG. 8, a muffler assembly 65 may be arranged on the removable plate 91 of the valve body housing 44. In some implementations, the muffler assembly 65 comprises sidewall sound absorbing panels 99 and a bottom sound absorbing panel 101. The sidewall and bottom sound absorbing panels 99, 101 are configured to absorb sound to reduce noise produced by the pump 10. Thus, the muffler assembly 65 reduces noise produced by the pump 10. The muffler assembly 65 comprises a cover 103 that encloses the muffler features to the removable plate 91. The cover 103 of the muffler assembly 65 protects the muffler assembly 65 from damage by fluids and other debris arranged above the muffler assembly 65.

Figure 9:
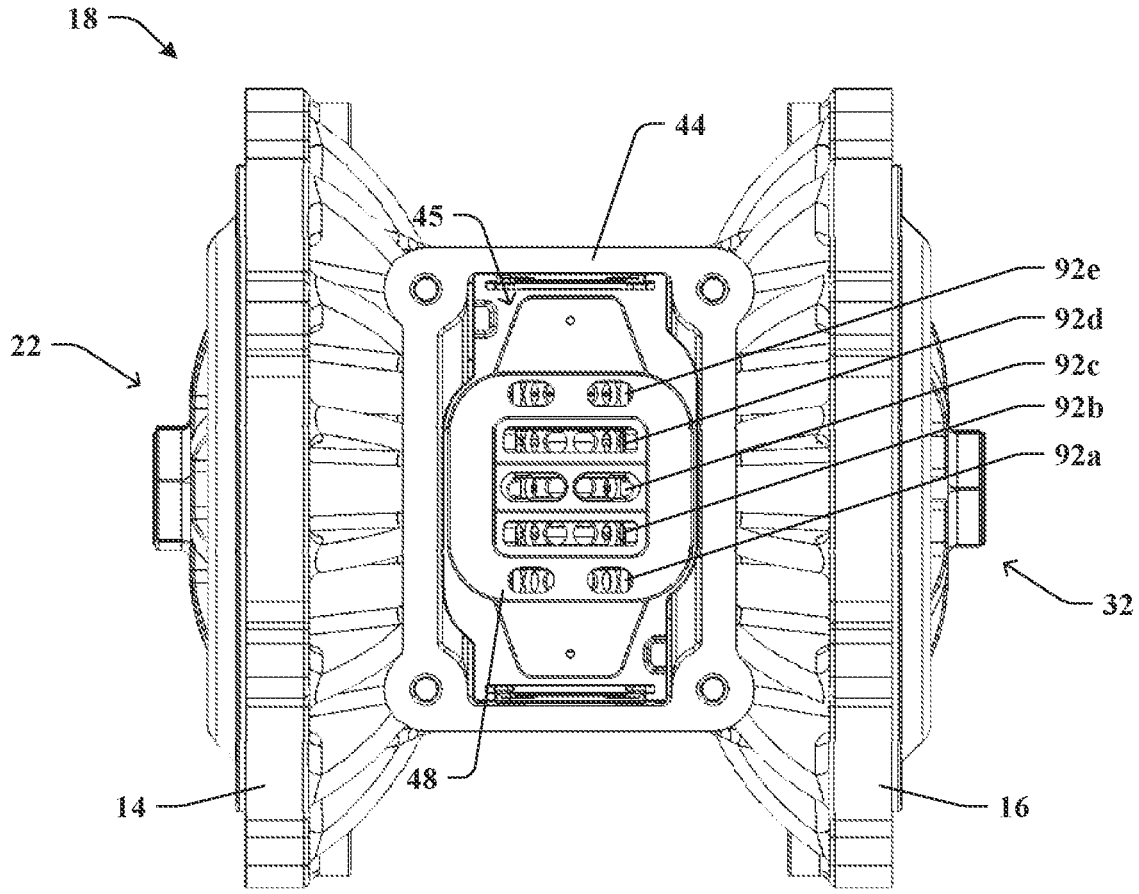
FIG. 9 illustrates a front view of some implementations of a center section of the pump as described herein.

With additional reference to FIG. 9, in some implementations, the main fluid valve sleeve 92 comprises five rows of openings including a first row 92*a*, a second row 92*b*, a third row 92*c*, a fourth row 92*d*, and fifth row 92*e*. In some implementations, as best seen in FIGS. 4 and 9, the first row 92*a* is arranged directly behind the second compressed air feed 100; the second row 92*b* is arranged directly behind the second chamber port 104; the third row 92*c* is arranged directly behind the muffler exhaust port 62; the fourth row 92*d* is arranged directly behind the first chamber port 102; and the fifth row 92*e* is arranged directly behind the first compressed air feed 98.

Figure 10A:
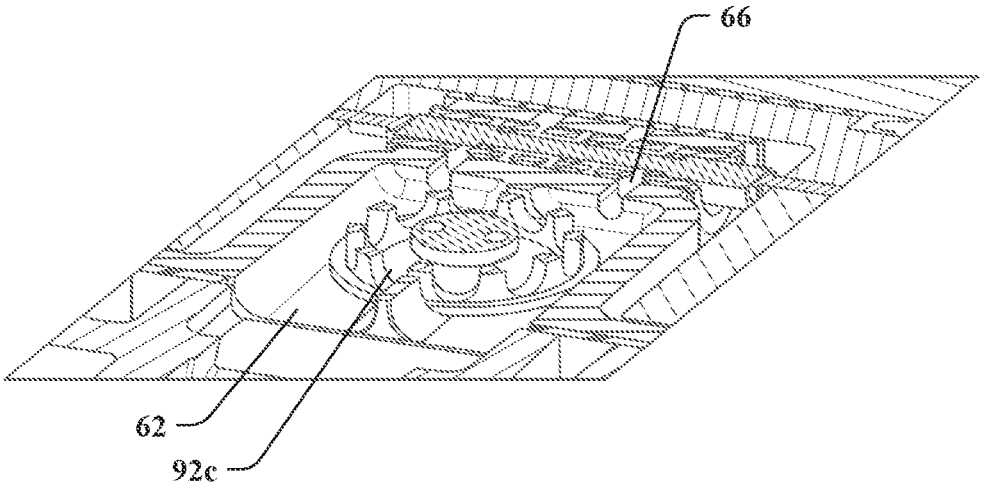
FIGS. 10A and 10B illustrate cross-sectional views of some implementations of the selectably removable valve body of the pump as described herein.
Figure 10B:
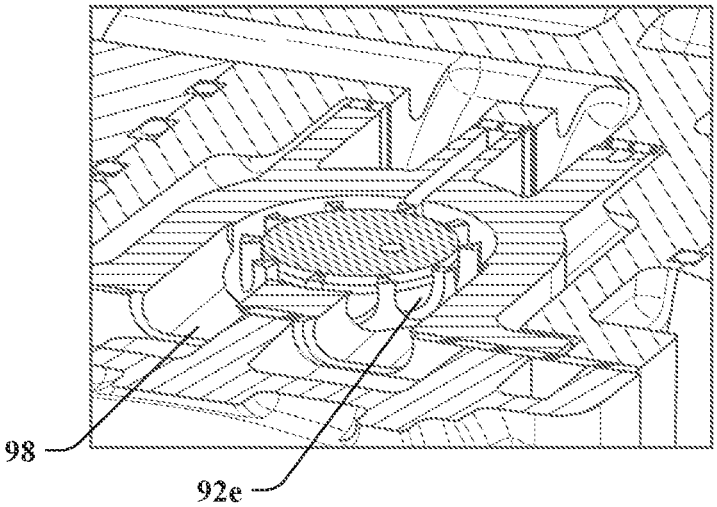

Additionally, FIG. 10A corresponds to cross-section line BB' of FIG. 3A, and FIG. 10B corresponds to cross-section line CC' of FIG. 3A. As shown in FIG. 10A, in some implementations, the pilot valve sleeve 66 is arranged behind the main fluid valve sleeve 92 but comprises openings that are at least fluidly connected to the third row 92*c* of the main fluid valve sleeve 92 and thus, the pilot valve sleeve 66 is fluidly connected to the muffler exhaust port 62 via the main fluid valve sleeve 92. In some implementations, as shown in FIG. 10B, the first compressed air feed 98 is fluidly connected to the fifth row 92*e* of the main fluid valve sleeve 92. Thus, FIGS. 10A and 10B illustrate examples of fluid connections between the main fluid valve sleeve 92 and the ports (e.g., 62, 98, etc.) that allow the ports to be on the same front side of the valve body signal surface 48 for easier accessibility to the ports. Therefore, in some implementations, the ports on the valve body signal surface 48 can be accessed from the pump 10 by simply removing the removable plate 91 and the front gasket 93 from the valve body housing 44.

Figure 11:
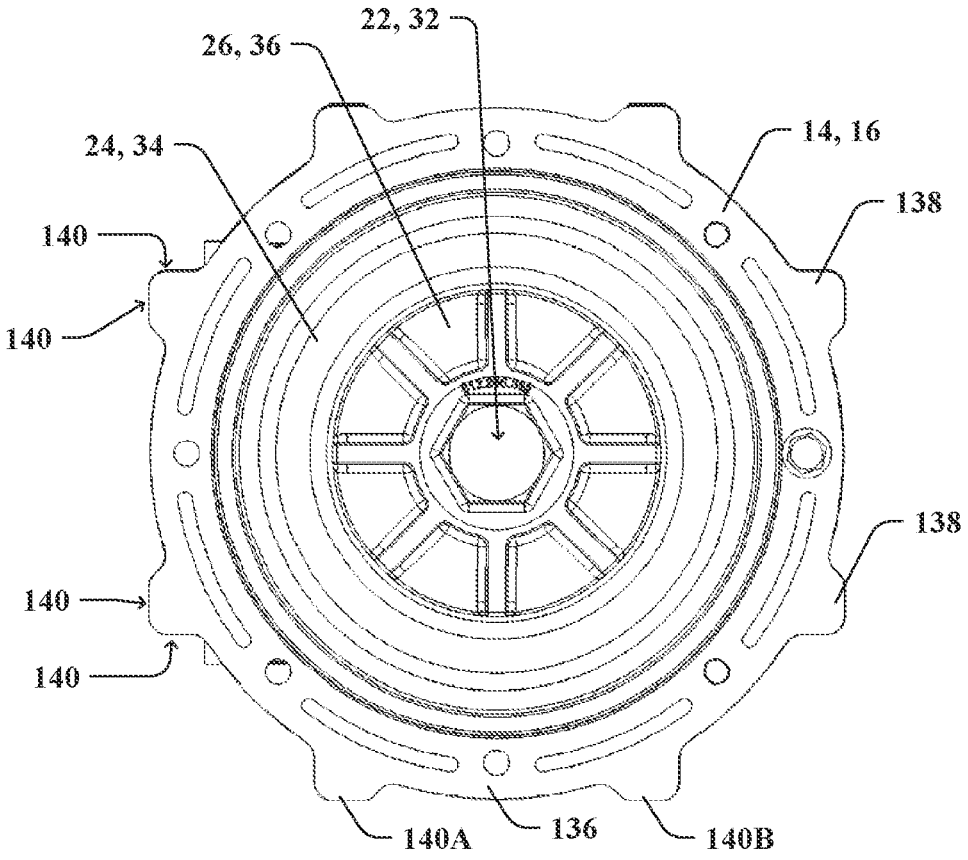
FIG. 11 illustrates a side view of some implementations of the center section of the pump as described herein.
Figure 12:
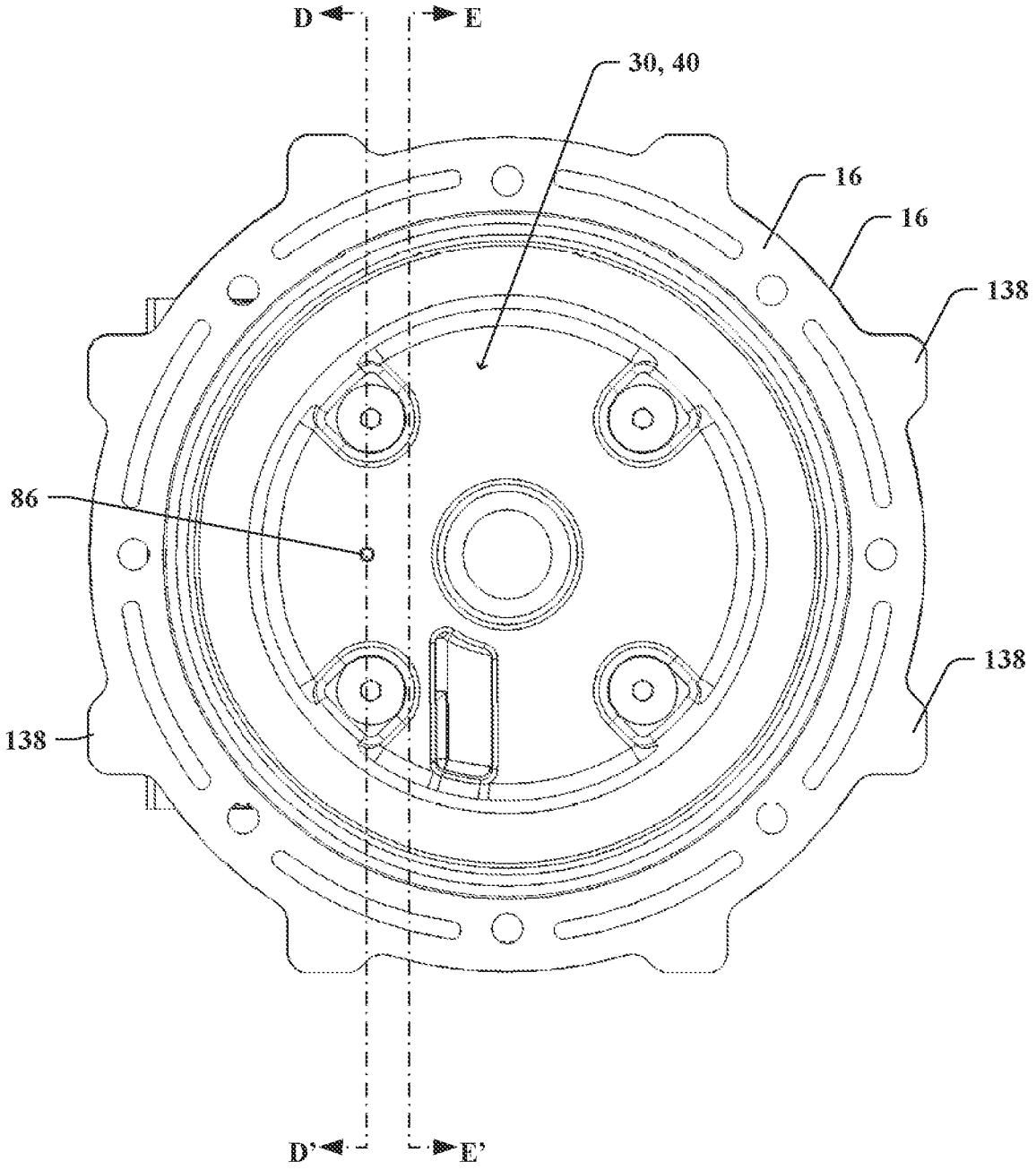
FIG. 12 illustrates a side view of some implementations of diaphragm chamber housing of the pump as described herein.

FIG. 11 illustrates some implementations of a side view of some implementations of the first and second diaphragm chamber housings 14, 16, including the first and second diaphragms 24, 34, and FIG. 12 corresponds to the side view of FIG. 11 but without the first and second diaphragms 24, 34. Thus, the first and second diaphragm chambers 30, 40 are exposed in FIG. 12. As shown in FIGS. 11 and 12, in some implementations, each of the first and second diaphragm chamber housings 14, 16 may comprise diaphragm chamber outer edges 136. The diaphragm chamber outer edges 136 may comprise a plurality of stabilizing feet 138. The stabilizing feet 138 may be equally and radially spaced around the outer edges 136 of the diaphragm chamber housings 14, 16. The stabilizing feet 138 may be extrusions off the outer edges 136 of the diaphragm chamber housings 14, 16 that prevent the first and second diaphragm chamber housings 14, 16 from moving or rolling during maintenance or tear down of the pump 10.

Each extrusion that defines the stabilizing feet 138 may be comprised of at least two planar surfaces 140. The planar surfaces 140 may extend out past the outer edges 136 of the first and second diaphragm chamber housings 14, 16 so that two planar surfaces 140 from two proximate stabilizing feet 138 provide two points of contact with a surface that the pump 10 may be resting on. For example, in FIG. 11 planar surfaces 140A and 140B extend past the outer edge 136 and provide two points of contact and substantially flat surfaces for the pump 10 to rest on. The stabilizing feet 138 may be spaced sufficiently apart to prevent the pump 10 from rolling or tipping while resting on the stabilizing feet 138. In one implementation, the planar surfaces 140 may be substantially perpendicular to each other. It should be appreciated that the surfaces may have some other angular relationship to each other depending on the number of stabilizing feet 138 and the spacing of stabilizing feet 138 around outer edges 136 of the pump housings.

Further, referring back to FIG. 3A, in some implementations, the valve body 45 has protruding feet 53 such that the valve body 45 can also be placed on a flat surface (e.g., a table, a work bench, etc.) upon removal of the valve body 45 from the pump 10 for maintenance. It should be appreciated that the protruding feet 53 on the valve body 45 may have a different structure and/or location(s) on the valve body 45 than what is illustrated in FIG. 3A.

Figure 13:
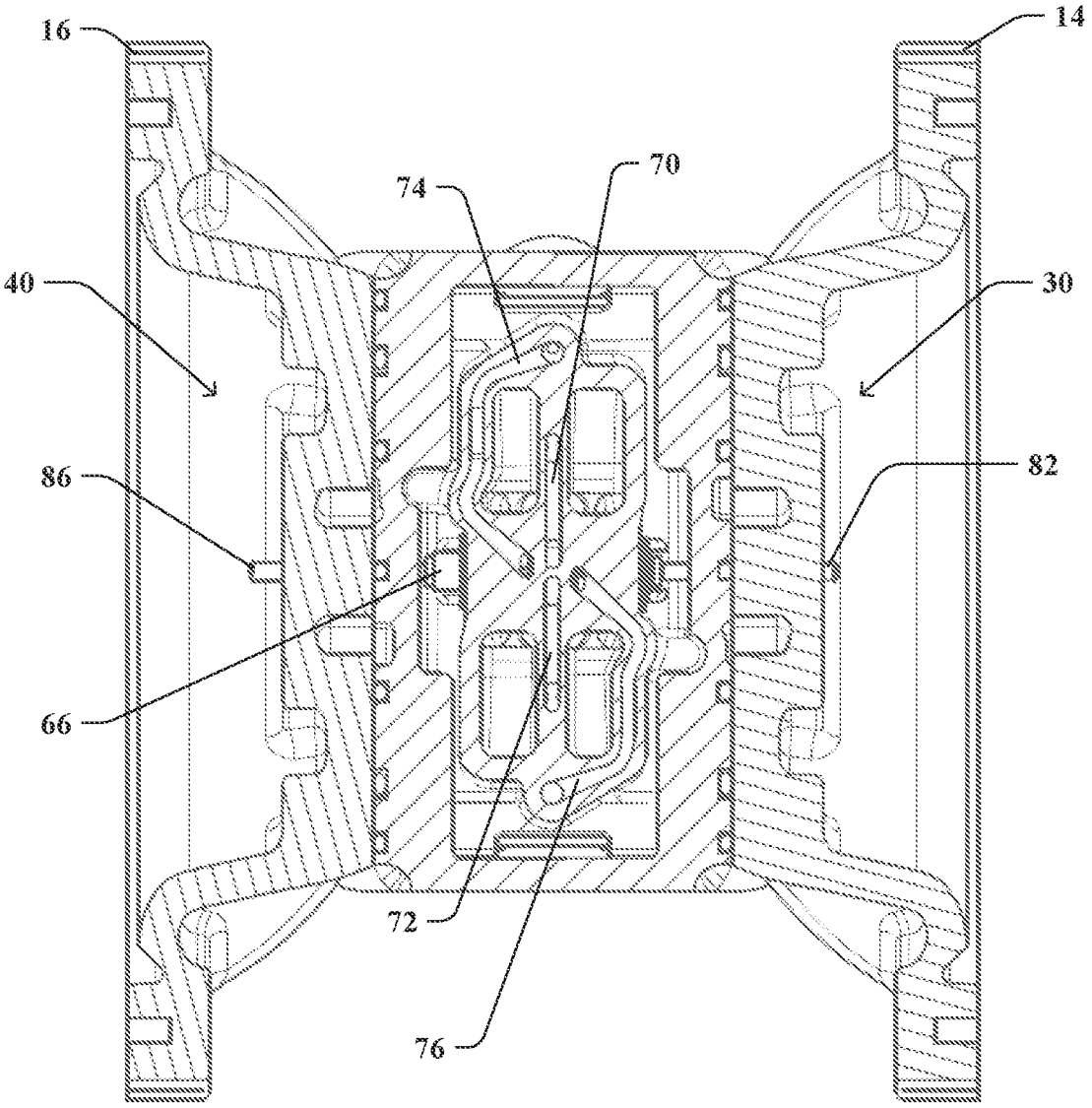
FIG. 13 illustrates a cross-sectional view of some implementations of the center section of the pump, a pilot inlet port, and main channels of the valve body as described herein.

FIG. 13 illustrates a cross-sectional view of some implementations of the center section 18 of the pump 10. The cross-sectional view in FIG. 13 may correspond to cross-section line DD' of FIG. 12. As shown in FIG. 13, the pilot valve sleeve 66 is arranged behind the first and second pilot inlet ports 70, 72 and the first and second main channels 74, 76 of the valve body 45.

Figure 14A:
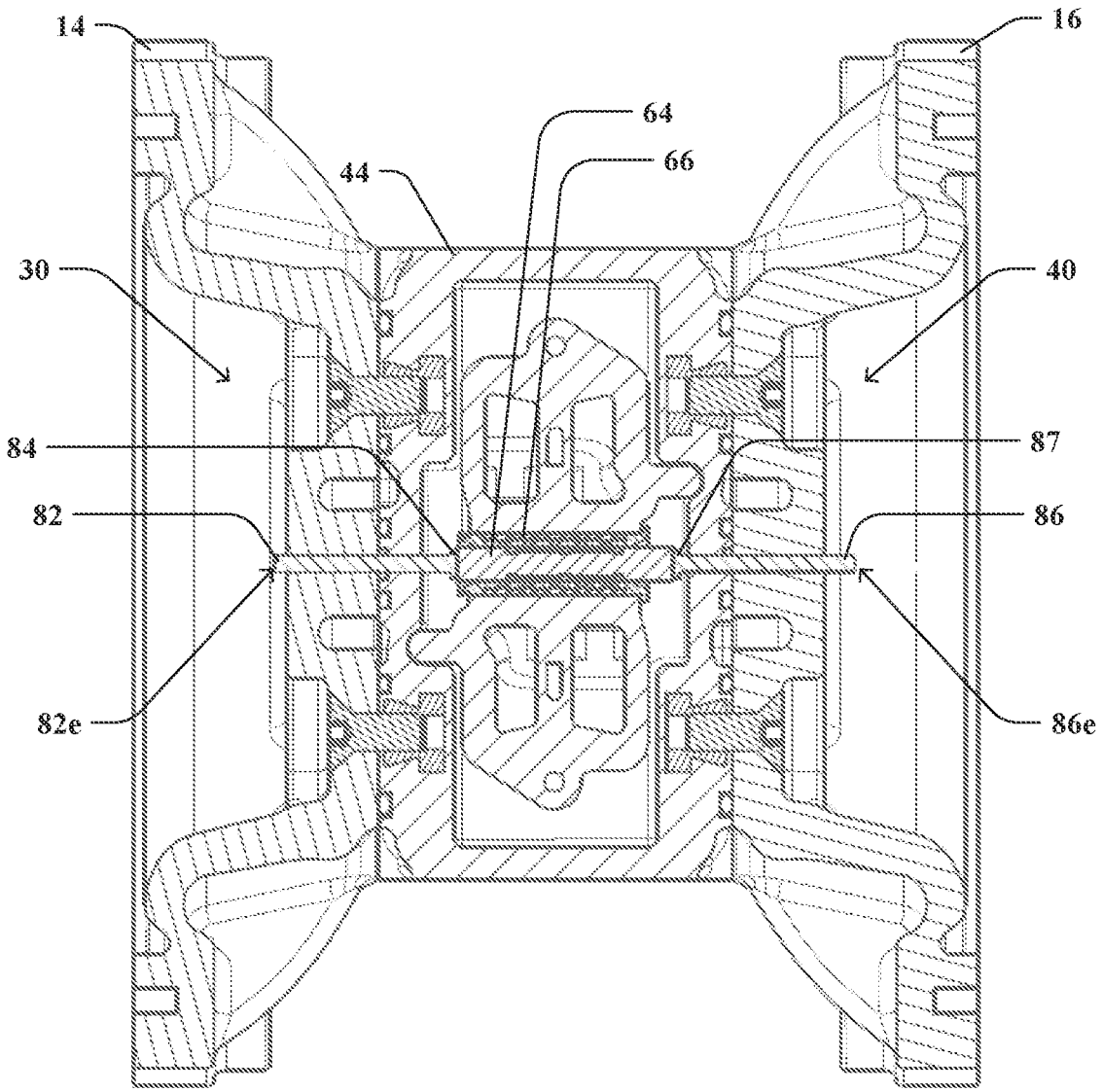
FIGS. 14A, 14B, and 14C illustrate various cross-sectional views of some implementations of the center section of the pump when the pilot valve assembly is in multiple positions as described herein.
Figure 14B:
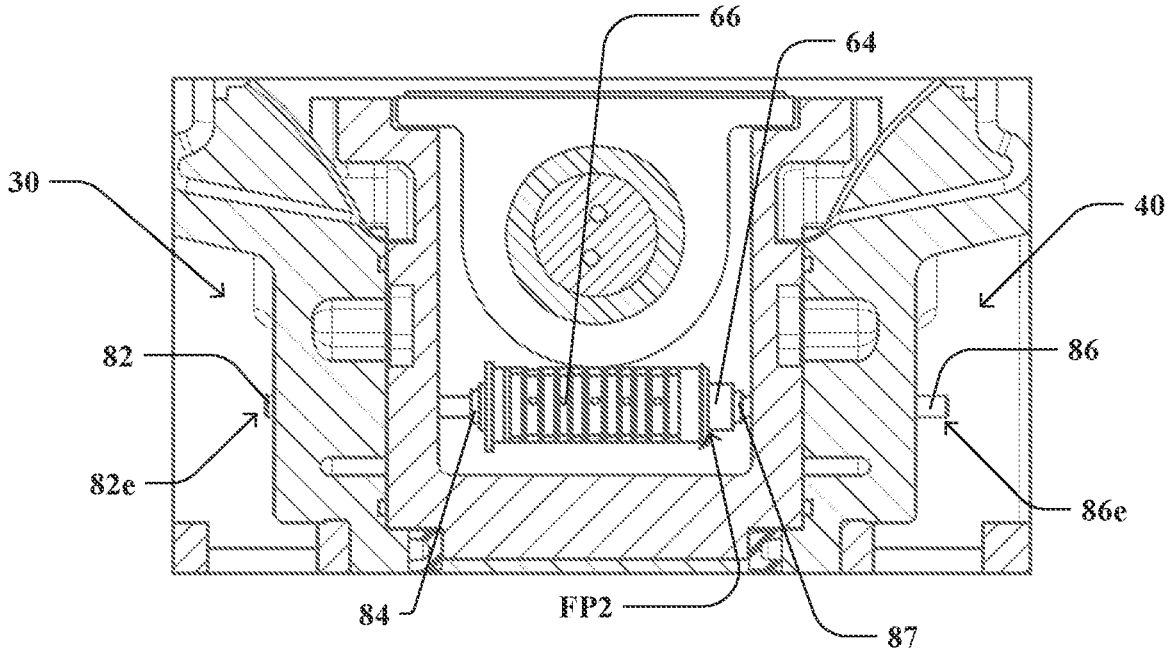
Figure 14C:
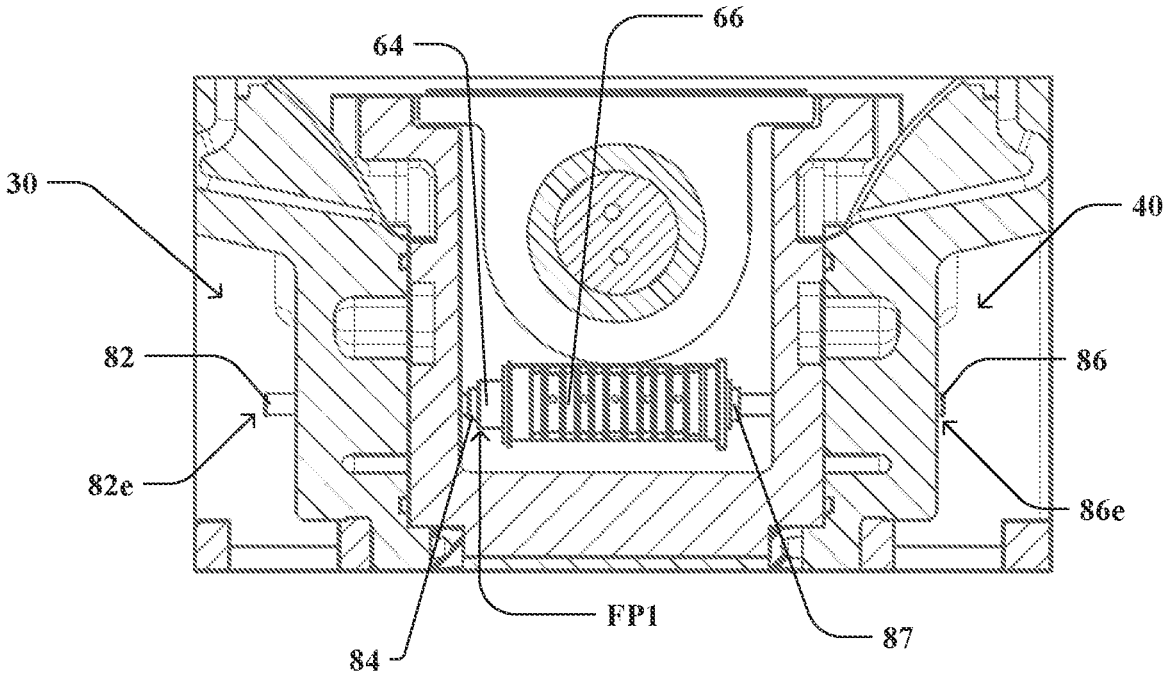

Turning additionally to FIGS. 14A, 14B, and 14C, the positions and movement of the pilot valve spool 64 are illustrated. FIG. 14A illustrates a cross-sectional view of some implementations of the center section 18 of the pump 10 and may correspond to cross-section line EE' of FIG. 12. The pilot valve spool 64 may be coupled to first and second actuator pins 82, 86. The pilot valve spool 64 may be movable between a first pilot position FP1 (e.g., FIG. 14C) and a second pilot position FP2 (e.g., FIG. 14B).

The first actuator pin 82 may be positioned so that a first actuator pin 84 is located in the valve body housing 44; the first actuator pin 82 extends through the valve body housing 44 and the first diaphragm chamber housing 14; and a first actuator pin end 82*e* is located in the first diaphragm chamber 30. The second actuator pin 86 may be positioned so that a second actuator pin 87 is located in the valve body housing 44; the second actuator pin 86 extends through the valve body housing 44 and the second diaphragm chamber housing 16; and a second actuator pin end 86*e* is located in the second diaphragm chamber 40. The first and second actuator pins 82, 86 may be positioned so that central axes of the pins align with a central axis of the pilot valve spool 64.

As the pump 10 operates, the first diaphragm plate 26 may contact the first actuator pin end 82*e* moving the pin so that the first actuator pin 84 contacts the pilot valve spool 64, thereby moving the pilot valve spool 64 to the second pilot position FP2 as shown in FIG. 14B. Alternatively, as the pump 10 operates, the second diaphragm plate 36 may contact the second actuator pin end 88 moving the pin so that the first actuator pin 87 contacts the pilot valve spool 64 thereby moving the pilot valve spool 64 to the first pilot position, FP1 as shown in FIG. 14C.

The length of the pilot valve spool 64 may be configured so that the first and second actuator pins 84, 87, and thus, the first and second actuator pins 82, 86 are not able to enter the pilot valve sleeve 66 as the pump 10 operates. As the first and second diaphragm assemblies 22, 32 move and interact with the first and second actuator pins 82, 86, the length of the pilot valve spool 64 may prevent the actuator pins from entering the pilot valve sleeve 66. The first and actuator pins 84, 87 may move within the valve body housing 44 to facilitate the operation of the pump 10. However the length of the pilot valve spool 64 may fully prevent the actuator pins 84; 86 from entering the pilot valve sleeve 66 when in the first pilot position FP1, when in the second pilot position FP2, or when in between the first pilot position FP1 and the second pilot position FP2. Preventing insertion of the first and second actuator pins 82, 86 into the pilot valve sleeve allows for the removal of the valve body 45 from the valve body housing 44 without having to adjust the position of one of the actuator pins 84, 87. Thus, adjustment of the actuator pins 84, 87 is eliminated which increases the efficiency and convenience of removing the valve body housing 44 for maintenance.

In some implementations, the movement of the pilot valve spool 64 may be caused by the first actuator pin 82 being contacted by the first diaphragm plate 26 or the second actuator pin 86 being contacted by the second diaphragm plate 36. The first and second pilot inlet ports 70, 72 may communicate compressed air to the first main channel 74 and the second main channel 76. The first and second pilot inlet ports 70, 72 are connected to one another to increase the compressed air flow into the first and second main channels 74, 76. Thus, the first and second pilot inlet ports 70, 72 are connected to a main air supply to supply compressed air to the pilot valve spool 64 by way of the first and second main channels 74, 76.

As shown in FIG. 6 as well as in FIGS. 14A, 14B, and 14C, the pilot valve spool 64 may comprise a first pilot passageway 78 and a second pilot passageway 80 such that when the pilot valve spool 64 moves into the first pilot position FP1, the first pilot passageway 78 communicates compressed air from the first and second pilot inlet ports 70, 72 to the first main channel 74. Further, in the first pilot position FP1, the pilot valve spool 64 may be positioned to prevent the communication of compressed air from the first and second pilot inlet ports 70, 72 to the second pilot passageway 80 and the second main channel 76. When the pilot valve spool 64 moves into the second pilot position FP2, the second pilot passageway 80 communicates compressed air from the first and second pilot inlet ports 70, 72 to the second main channel 76. Further, in the second pilot position FP2, the pilot valve spool 64 may be positioned to prevent the communication of compressed air to the first pilot passageway 78 and the first main channel 74.

Figure 15A:
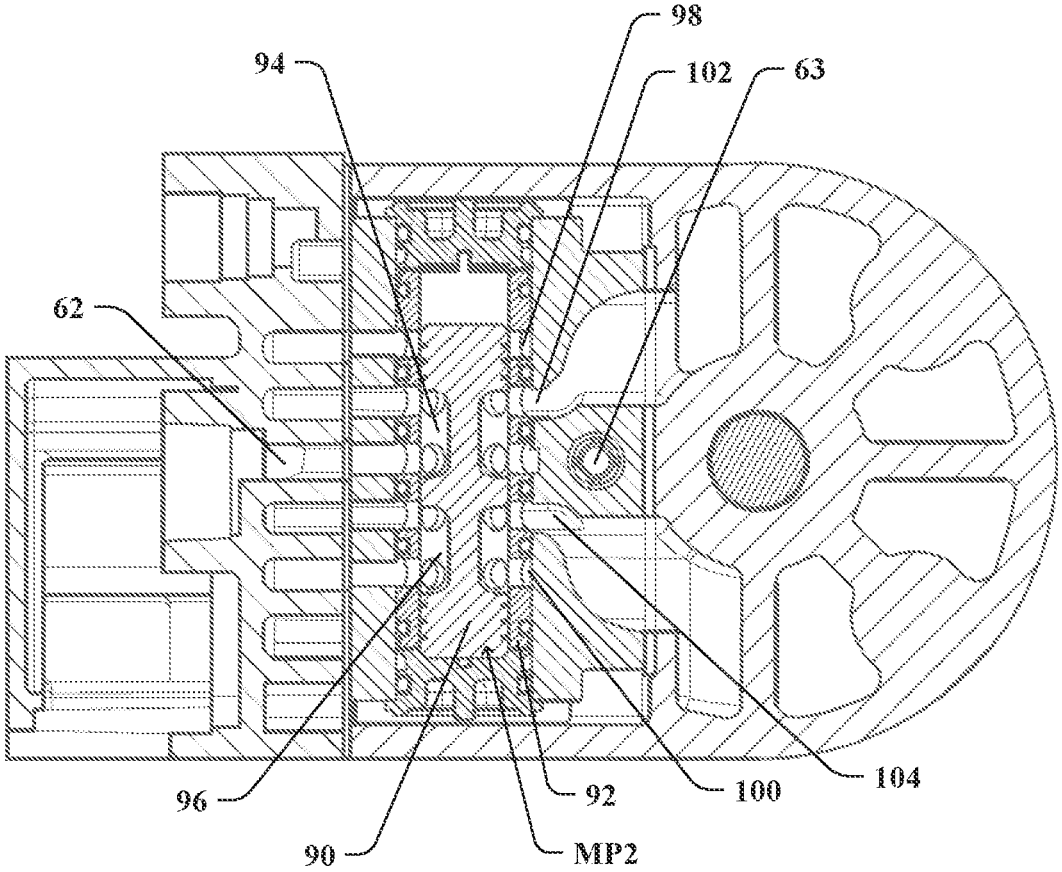
FIGS. 15A and 15B illustrate cross-sectional views of some implementations of the center section of the pump including a main fluid valve spool in multiple positions as described herein.
Figure 15B:
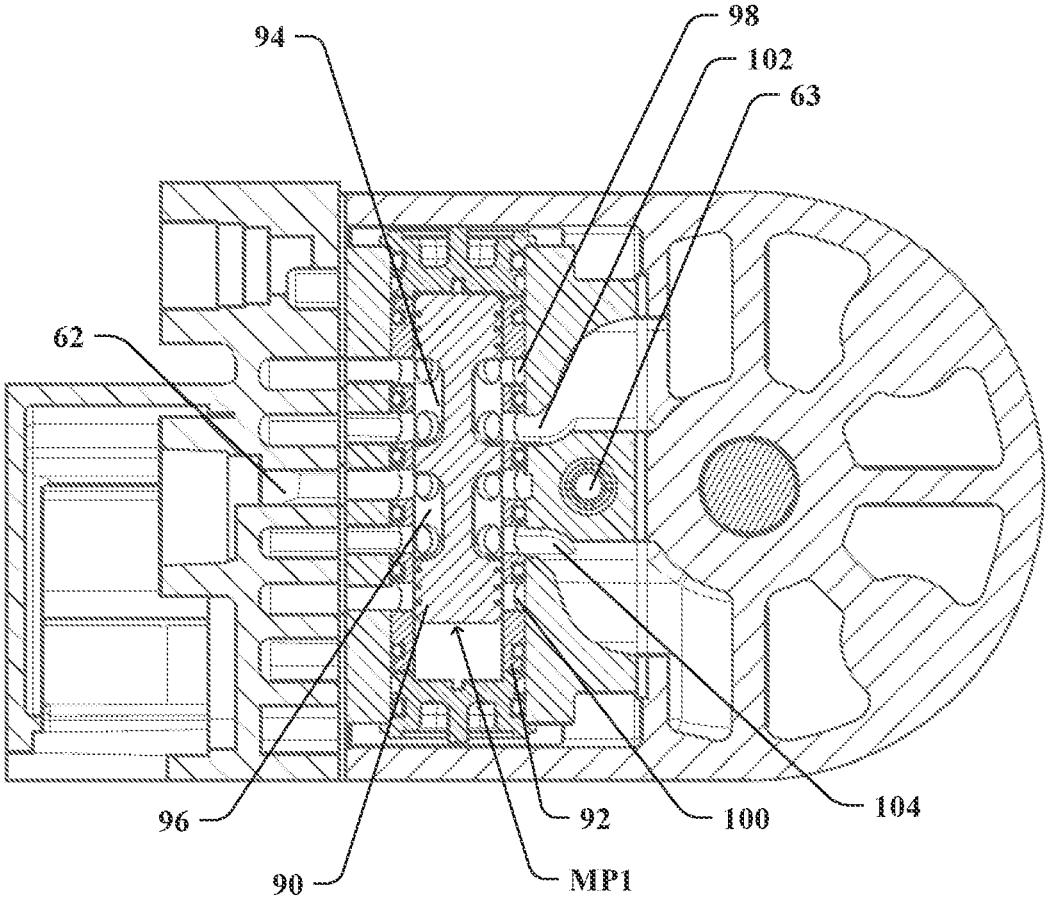

FIGS. 15A and 15B illustrate cross-sectional views of some implementations of the center section 18 of the pump 10 including a main fluid valve spool 90 in multiple positions as described herein. The cross-sectional views of FIGS. 15A and 15B may correspond to cross-section line FF' of FIG. 5C.

With reference to FIGS. 3A, 4, 6, 15A, and 15B, in some implementations, the communication of compressed air to the first or second pilot signal port 51, 52 from the first signal or second main channels 74, 76 may cause the main fluid valve spool 90 to move between a first and second main position MP1, MP2, respectively. In one implementation, the communication of compressed air to the first pilot signal port 51 from the first main channel 74 may cause the main fluid valve spool 90 to move from the first main position MP1 to the second main position MP2, shown in FIG. 15A. In the first main position MP1, the first main passageway 94 allows fluid communication between the first main channel 74 and the first diaphragm chamber 30 to allow fluid to flow into the chamber. In the first main position MP1, the second main passageway 96 allows fluid communication from the second diaphragm chamber 40 to the muffler exhaust port 62. In the second main position MP2, the first main passageway 94 allows fluid communication between the first diaphragm chamber 30 and the muffler exhaust port 62. In the second main position MP2, the second main passageway 96 allows fluid communication between the second main channel 76 and the second diaphragm chamber 40.

As shown in FIG. 6 and with additional reference to FIG. 1C, the main fluid valve spool 90 may comprise a first main passageway 94 and a second main passageway 96. The movement of the main fluid valve spool 90 to the second main position MP2 may cause the second main passageway 96 to be positioned to allow compressed air to flow from the second compressed air feed 100, through the second chamber port 104, and into the second diaphragm chamber 40, thereby causing the second diaphragm chamber 40 to be filled with compressed air.

Additionally, the first main passageway 94 of the main fluid valve spool 90 may be positioned to allow compressed air to be exhausted from the first diaphragm chamber 30 through the first chamber port 102 then through the muffler exhaust port 62. The communication of compressed air to the second pilot signal port 52 may cause the main fluid valve spool 90 to move from the second main position MP2 to the first main position MP1 shown in FIG. 15B. The movement of the main fluid valve spool 90 to the first main position MP1 may cause the first main passageway 94 to be positioned to allow compressed air to flow from the first compressed air feed 98 through the first chamber port 102, and into the first diaphragm chamber 30 thereby causing the first diaphragm chamber 30 to be filled with compressed air. Additionally, the second main passageway 96 of the main fluid valve spool 90 may be positioned to allow compressed air to be exhausted from the second diaphragm chamber 40 via the muffler exhaust port 62.

The connecting rod 42 may at least partially allow the first and second diaphragm assemblies 22, 32 to reciprocate together between a first end of stroke position EOS1, and a second end of stroke position EOS2. The first and second end of stroke positions EOS1, EOS2 may represent a hard-stop or physically limited position of the first and second diaphragm assemblies 22, 32, as restricted by the mechanics of the pump. Next, each of the diaphragm assemblies 22,32 within respective first and second diaphragm chamber housings 14, 16 may have a first diaphragm position $DP1_L$, $DP1_R$ and a second diaphragm position $DP2_L$, $DP2_R$, respectively. The first and second diaphragm positions $DP1_L$, $DP1_R$, $DP2_L$, $DP2_R$ may correspond to a predetermined and/or detected position of the first and second diaphragm assemblies 22, 32 that is reached prior to the respective end of stroke position EOS1, EOS2.

In one implementation, the first diaphragm position $DP1_L$, $DP1_R$ may comprise a position wherein the compressed air has been substantially exhausted from the first and second diaphragm chambers 30, 40 and a pumped fluid has been suctioned or otherwise communicated into the pumping chamber 28, 38. In the first diaphragm position $DP1_L$, $DP1_R$ the first and second diaphragm plates 26, 36 may contact an end portion of first and second actuator pins 82, 86 thereby initiating the movement of a pilot valve spool 64. The second diaphragm position $DP2_L$, $DP2_R$ may comprise a position wherein the first and second diaphragm chambers 30, 40 are substantially filled with compressed air and the pumped fluid has been substantially exhausted from the first and second pumping chambers 28, 38. In the second diaphragm position $DP2_L$, $DP2_R$ the first and second diaphragm plates 26, 36 may be positioned completely out of contact with the first and second actuator pins 82, 86.

Generally, the pump 10 may operate by continuously transitioning between a first pump state PS1 and a second pump state PS2. The first pump state PS1, may comprise the pilot valve spool 64 in the first pilot position FP1 (shown in FIG. 14C); the main fluid valve spool 90 in the second main position MP2 (shown in FIG. 15A); and, the first and second diaphragm chambers 30, 40 in the first end of stroke position EOS1. The second pump state PS2, may comprise the pilot valve spool 64 in the second pilot position FP2 (shown in FIG. 14B); the main fluid valve spool 90 in the first main position MP1 (shown in FIG. 15B); and, the first and second diaphragm assemblies 22, 32 in the second end of stroke position EOS2.

With the pilot valve spool 64 in the first pilot position FP1 (shown in FIG. 14C), compressed air is communicated to the first pilot signal port 51 and the main fluid valve assembly 89 via the second main channel 76. In one implementation, the main fluid valve spool 90 may initially be in the first main position MP1 and the initial communication of the compressed air to the first pilot signal port 51 may cause the main fluid valve spool 90 to move from the first main position MP1 to the second main position MP2. The second main channel 76 may be in fluid communication with the second compressed air feed 100. In the second main position MP2, the second main passageway 96 of the main fluid valve spool 90 may allow compressed air to flow through the pilot valve assembly 63 and into the second diaphragm chamber 40 as described above. Additionally, the main fluid valve spool 90 may prevent or block compressed air from being communicated through the pilot valve assembly 61 to the first diaphragm chamber 30. Instead, the main fluid valve spool 90 may allow compressed air to be vented or exhausted from the first diaphragm chamber 30 through the muffler exhaust port 62 as described above.

The compressed air may continue to be communicated into the second diaphragm chamber 40 and exhausted from the first diaphragm chamber 30. The continued communication and exhaustion of compressed air into the second diaphragm chamber 40 and from the first diaphragm chamber 30 may cause the second diaphragm assembly 32 to move away from the first diaphragm position DP1 and towards the second diaphragm position DP2 and may cause the first diaphragm assembly 22 to move away from the second diaphragm position DP2, and towards the first diaphragm position DP1. Upon the second diaphragm assembly 32 reaching the second end of stroke position EOS2, the pump 10 may comprise the second pump state PS2. The first diaphragm plate 26 may be in contact with the first actuator pin 82 causing the pilot valve spool 64 to move to the second pilot position FP2 wherein compressed air is communicated through the valve body 45 and the pilot valve assembly 63 to the second pilot signal port 52 of the main fluid valve assembly 89.

The continued communication of compressed air to the second pilot signal port 52 may cause the main fluid valve spool 90 to shift or move away from the second main position MP2 and into the first main position MP1. In the first main position MP1, the main fluid valve spool 90 of the main fluid valve assembly 89 may thereby block or prevent the communication of compressed air through the second compressed air feed 100 and may position the first compressed air feed 98 to allow compressed air to be communicated from the first main channel 74 to the first diaphragm chamber 30. While the first diaphragm chamber 30 is being filled with compressed air, the second diaphragm chamber 40 may be vented through the muffler exhaust port 62 of the main fluid valve assembly 89.

Referring additionally to FIGS. 13, 15A, and 15B, in order to provide all of the ports on the valve body signal surface 48, the valve body 45 may comprise several independent fluid communication channels to facilitate the movement of air through the valve body allowing the operation of the pump 10. In other words, the independent fluid communication channels are configured such that the signal ports are arranged on the same planar valve body signal surface 48 for easy operator accessibility which improves manufacturing efficiency. For example, in some implementations the valve body 45 may include channels for fluid communication between the pilot inlet ports 70, 72 to the pilot valve assembly 63. The valve body 45 may include first and second main channels 74, 76 for fluid communication between the pilot valve assembly 63 and the main fluid valve assembly 89 to fill the first and second diaphragm chambers 30, 40. The valve body 45 may include first and second main channels 74, 76 for fluid communication between the pilot valve assembly 63, the first and second pilot signal ports 51, 52, and the main fluid valve assembly 89 to move the main fluid valve assembly between the first and second main positions MP1, MP2. The main fluid valve spool 90 may include first and second main passageways 94, 96 which may allow for fluid communication between the main first and second main channels 74, 76, the first and second diaphragm chambers 30, 40, and the exhaust ports 102, 104, 62 on the valve body signal surface 48.

Figure 16:
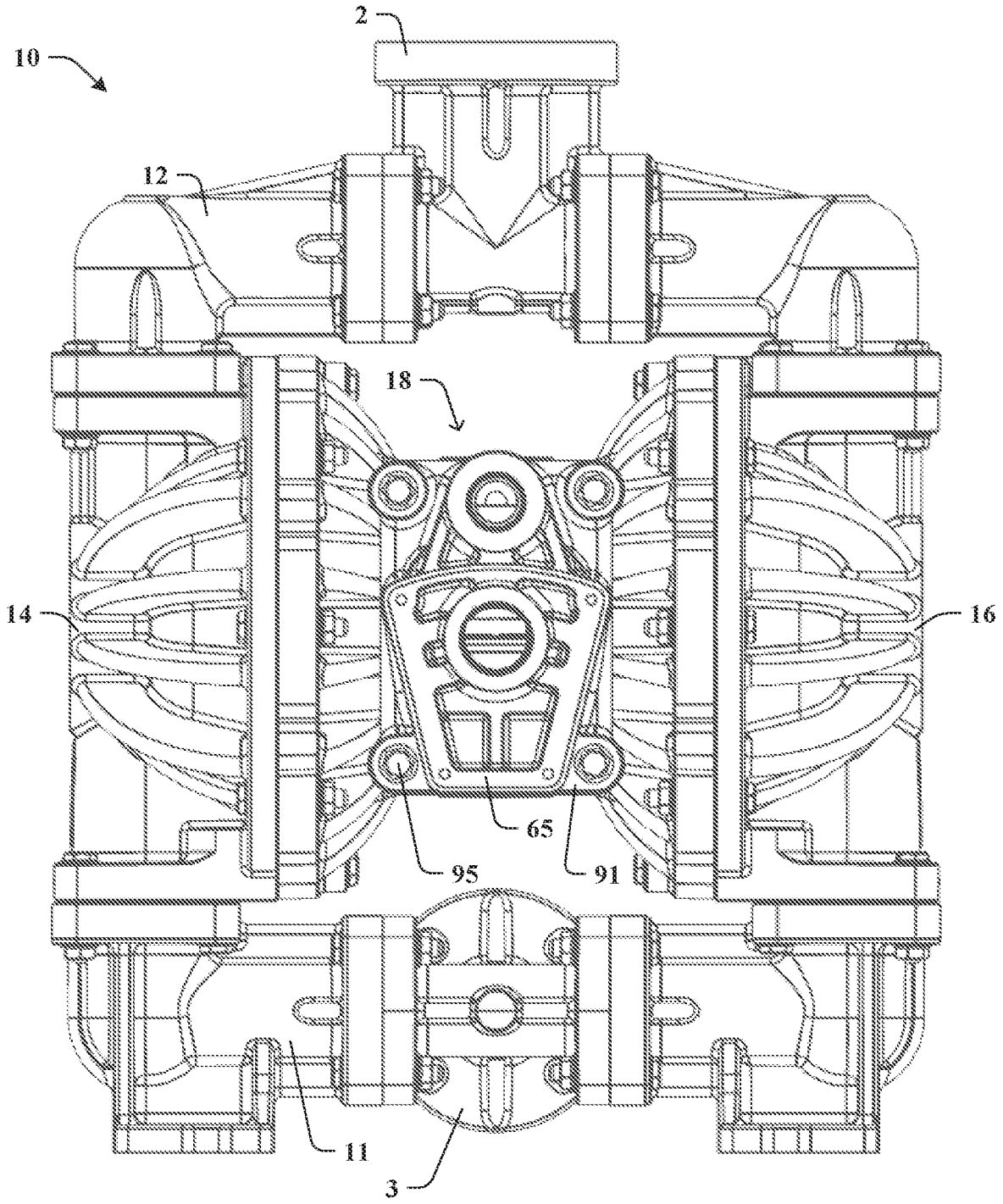
FIG. 16 illustrates a front view of some implementations of an air operated double diaphragm pump with accessible features as described herein.

Turning additionally to FIG. 16 and also in view of FIG. 2, it will be appreciated that this disclosure is not limited to the overall pump 10 design illustrated in FIG. 2. In FIG. 2, fluid may enter into the pump 10 through a main entry inlet 3 and exit the pump 10 through a main exit outlet 2. In some implementations, the main entry inlet 3 and the main exit outlet 2 are faced away from the opening of the valve body housing 44 where the valve body 45 is accessed. Therefore, when an operator accesses the valve body 45, fluid leakage from the main entry inlet 3 and the main exit outlet 2 is less likely to contaminate the operator, the valve body housing 44, and the valve body 45. In some other implementations, as shown in FIG. 16, there can be alternative designs for the pump 10. In FIG. 16, the pump 10 has a main exit outlet 2 and a main entry inlet 3 that are arranged above and below from the valve body housing 44, while the main exit outlet 2 and the main entry inlet 3 are still facing away from the valve body housing 44.

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A pump comprising:

a first diaphragm chamber housing and a second diaphragm chamber housing, each comprising a diaphragm that defines a diaphragm chamber;

a valve body housing disposed between the diaphragm chamber housings configured to be in fluid communication with each diaphragm chamber; and a valve body disposed within the valve body housing such that several sides of the valve body are surrounded by the valve body housing, the valve body being a single component and comprising:

at least one inlet port, at least one exhaust port, a pilot valve bore housing a pilot valve assembly, a main fluid valve bore housing a main fluid valve assembly, the main fluid valve bore being different than the pilot valve bore, and channels for fluid communication between the pilot valve bore, the main fluid valve bore, the diaphragm chambers, the inlet ports, and the exhaust ports, wherein the valve body is configured to be selectably removeable from the valve body housing, wherein the valve body is configured such that the pilot valve assembly and the main fluid valve assembly remain housed within the valve body during the selective removal of the valve body from the valve body housing, wherein the pilot valve assembly comprises a pilot valve sleeve and a pilot valve spool, the pilot valve assembly configured to be selectably removable from the valve body, and wherein the main fluid valve assembly comprises a main fluid valve sleeve and a main fluid valve spool, the main fluid valve assembly configured to be selectably removable from the valve body.

2. The pump of claim 1, further comprising a first actuator pin and a second actuator pin, each pin disposed between the valve body housing and the diaphragm chamber housings so that each actuator pin has a first end that engages with the diaphragm and second end that engages with the pilot valve spool;

wherein the pilot valve spool is longer than the pilot valve sleeve and protrudes from outer surfaces of the valve body to prevent the second end of the first and second actuator pins from entering the pilot valve sleeve.

3. The pump of claim 1, wherein each diaphragm chamber housing further comprises an outer edge, the outer edge including a plurality of stabilizing feet radially spaced around the outer edge of each diaphragm chamber housing, the plurality of stabilizing feet configured to directly contact a surface to support and stabilize the pump during maintenance of the pump.

4. The pump of claim 1, wherein an entirety of the valve body is arranged directly between the diaphragm chamber housings.

5. The pump of claim 1, wherein each diaphragm is operably coupled to an actuator pin, wherein each actuator pin extends through the valve body housing and is configured to actuate the pilot valve spool during operation of the pump, and wherein each actuator pin remains within the valve body housing when the valve body is selectably removed from the valve body housing.

6. The pump of claim 5, wherein each actuator pin is configured to actuate the pilot valve spool by directly contacting the pilot valve spool during operation of the pump.

7. A pump comprising:

a pair of diaphragm chamber housings, each comprising a diaphragm that defines a diaphragm chamber;

a valve body housing disposed between the diaphragm chamber housings configured to be in fluid communication with each diaphragm chamber, the valve body housing comprising a cavity; and a valve body disposed within the cavity and supported by the valve body housing such that the valve body is at least partially encased by the valve body housing, the valve body comprising a signal surface, a pilot valve assembly, a main fluid valve assembly different than the pilot valve assembly, at least one pilot inlet port, at least one pilot signal port, at least one diaphragm chamber inlet port, at least one chamber exhaust port, and an exhaust to a muffler, wherein the valve body is a single component;

wherein the pilot valve assembly further comprises a first and second pilot valve position and the main fluid valve assembly further comprises a first and second main fluid valve position, wherein the pilot valve assembly is in fluid communication with the main fluid valve assembly and the main fluid valve assembly is in fluid communication with the diaphragm chambers, wherein the position of the pilot valve assembly is configured to control the position of the main fluid valve assembly and the position of the main fluid valve assembly is configured to control fluid flow into one diaphragm chamber and fluid flow out of the opposite diaphragm chamber; and wherein the pilot signal ports, the diaphragm chamber inlet ports, the chamber exhaust ports, and the exhaust to the muffler are all accessible on the signal surface of the valve body, and wherein the signal surface is on a single side of the valve body and arranged in front of the pilot valve assembly and the main valve assembly.

8. The pump of claim 7, wherein the valve body is configured to be selectably removable from the valve body housing, and wherein the valve body is configured such that the pilot valve assembly and the main fluid valve assembly remain housed within the valve body during the selective removal of the valve body from the valve body housing.

9. The pump of claim 8, wherein the pilot valve assembly moves between the first and second valve positions upon mechanical actuation of the pilot valve assembly housed within the valve body with actuator pins within the diaphragm chamber housings, and wherein the actuator pins remain within the diaphragm chamber housings when the valve body is selectably removed from the valve body housing.

10. The pump of claim 8, wherein an entirety of the valve body is arranged directly between the first and second diaphragm chamber housings.

11. The pump of claim 7, further comprising channels for fluid communication between the pilot inlet port, the pilot signal port, the diaphragm chamber inlet port, the chamber exhaust port, and the exhaust to the muffler, wherein the channels are configured so all of the ports are accessible on the signal surface of the valve body.

12. The pump of claim 7, further comprising a removable plate operably coupled to the valve body housing, wherein the removable plate is selectably removable from the valve body housing to access the signal surface, and wherein the signal surface is planar.

13. A pump comprising:

an inlet;

an outlet;

a first diaphragm chamber housing and a second diaphragm chamber housing, each comprising a diaphragm that defines a diaphragm chamber;

a valve body housing arranged between the first and second diaphragm chamber housings;

a valve body arranged within the valve body housing, in fluid communication with the diaphragm chambers of the first and second diaphragm chamber housings, and comprising pilot signal ports, diaphragm chamber inlet ports, and chamber exhaust ports that are all accessible on a signal surface of the valve body, the signal surface being on a single side of the valve body, wherein a bottommost surface of the valve body is configured to contact and be supported by an inner lower surface of the valve body housing when arranged within the valve body housing;

wherein each diaphragm chamber housing further comprises an outer edge and a plurality of stabilizing feet, wherein the plurality of stabilizing feet are extrusions off the outer edges of the diaphragm chamber housings, and wherein each diaphragm chamber housing comprises at least two stabilizing feet having substantially flat surfaces configured to provide two points of contact with an underlying surface and to stabilize each diaphragm chamber housing when on the underlying surface; and a removable plate configured to be selectably removable from the valve body housing, wherein the valve body is encased by the removable plate and the valve body housing when the removable plate is coupled to the valve body housing, and wherein upon removal of the removable plate, the signal surface of the valve body is accessible.

14. The pump of claim 13, wherein the valve body is selectably removable from the valve body housing upon removal of the removable plate.

15. The pump of claim 13, wherein the valve body comprises a polymer, and wherein the removable plate and the valve body housing each comprise a conductive material.

16. The pump of claim 13, further comprising a muffler assembly coupled to the removable plate, wherein the muffler assembly comprises a cover that encloses muffler features to the removable plate.

17. The pump of claim 14, further comprising:

a pilot valve assembly disposed within a pilot valve bore of the valve body, the pilot valve assembly comprising a pilot valve sleeve and a pilot valve spool, the pilot valve assembly configured to be selectably removable from the valve body after the valve body is removed from the valve body housing; and a main fluid valve assembly disposed within a main fluid valve bore of the valve body, the main fluid valve assembly comprising a main fluid valve sleeve and a main fluid valve spool, the main fluid valve assembly configured to be selectably removable from the valve body after the valve body is removed from the valve body housing.

18. The pump of claim 17, wherein the valve body further comprises pilot inlet ports fluidly coupled with the pilot valve assembly, wherein the pilot inlet ports are arranged on a backside of the valve body, and wherein the signal surface is on a front side of the valve body.

19. The pump of claim 17, wherein the main fluid valve assembly is removably held within the valve body by valve body caps, wherein the pilot valve assembly is removably held within the valve body by a pilot valve retainer.

* * * * *